US010689980B2

(12) United States Patent
Hsu et al.

(10) Patent No.: US 10,689,980 B2
(45) Date of Patent: Jun. 23, 2020

(54) DOWNHOLE CHARACTERIZATION OF FLUID COMPRESSIBILITY

(71) Applicant: Schlumberger Technology Corporation, Sugar Land, TX (US)

(72) Inventors: Kai Hsu, Sugar Land, TX (US); Hadrien Dumont, Houston, TX (US); Anthony Robert Holmes Goodwin, Sugar Land, TX (US); Kentaro Indo, Sugar Land, TX (US); Julian Pop, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 116 days.

(21) Appl. No.: 15/594,232

(22) Filed: May 12, 2017

(65) Prior Publication Data

US 2017/0328202 A1 Nov. 16, 2017

Related U.S. Application Data

(60) Provisional application No. 62/336,434, filed on May 13, 2016.

(51) Int. Cl.
*E21B 49/10* (2006.01)
*E21B 49/08* (2006.01)

(52) U.S. Cl.
CPC ..... *E21B 49/10* (2013.01); *E21B 2049/085* (2013.01)

(58) Field of Classification Search
CPC ..... E21B 49/10; E21B 2049/085
See application file for complete search history.

(56) References Cited

U.S. PATENT DOCUMENTS

| | | | |
|---|---|---|---|
| 6,334,489 | B1 | 1/2002 | Shwe et al. |
| 6,474,152 | B1 | 11/2002 | Mullins et al. |
| 6,688,176 | B2 | 2/2004 | Storm, Jr. et al. |
| 7,346,460 | B2 | 3/2008 | DiFoggio et al. |
| 7,874,199 | B2 | 1/2011 | Chaudoreille et al. |
| 7,913,556 | B2 | 3/2011 | Hsu et al. |
| 8,434,356 | B2 | 5/2013 | Hsu et al. |

(Continued)

OTHER PUBLICATIONS

Dymond and Malhortra, "The Tait Equation: 100 Years on", Intl J of Thermophysics, 9 (6) 1988.*

(Continued)

*Primary Examiner* — Catherine T. Rastovski
(74) *Attorney, Agent, or Firm* — Trevor G. Grove

(57) ABSTRACT

A method includes operating a downhole acquisition tool in a wellbore in a geological formation. The wellbore or the geological formation, or both, contain a reservoir fluid. The method also includes receiving a portion of the reservoir fluid into the downhole acquisition tool and performing downhole fluid analysis using the downhole acquisition tool in the wellbore to determine at least one measurement associated with the portion of the reservoir fluid. The at least one measurement includes fluid density, optical density, or both. The method also includes using a processor of the downhole acquisition tool to obtain compressibility of the reservoir fluid based at least in part on the fluid density, the optical density, or both and determining a composition of the reservoir fluid based at least in part on the compressibility.

16 Claims, 20 Drawing Sheets

(56) References Cited

U.S. PATENT DOCUMENTS

| | | | | |
|---|---|---|---|---|
| 2009/0159334 | A1* | 6/2009 | Alberty | E21B 21/08 175/40 |
| 2009/0308600 | A1* | 12/2009 | Hsu | E21B 49/10 166/250.01 |
| 2011/0042070 | A1* | 2/2011 | Hsu | E21B 47/102 166/250.01 |
| 2013/0110401 | A1* | 5/2013 | Hsu | G01V 13/00 702/6 |
| 2016/0208600 | A1 | 7/2016 | Gisolf et al. | |

OTHER PUBLICATIONS

Le Neindre and Tufeu, "Application of the Tait Equation to the Determination of Thermophysical properties of Fluids Under Pressure ", Proc. Int. CODATA Conference, Kyoto, 1982, p. 411-414.*

Chen et al, "A New Approach to Obtain In-Situ Live Fluid Compressibility in Formation Testing", SPWLA 55th Annual Logging Symposium, May 18-22, 2014.*

R. Palmer, A. Santos de Silva, A. A. Al-Hajari, R. Engelman, A. van Zuilekom, and M. Proett, "Advances in Fluid Identification Methods Using a High Resolution Densitometer in a Saudi Aramco Field," SPWLA 49th Annual Logging Symposium , May 25-28, 2008.

L. P. Dake, Fundamentals of Reservoir Engineering. Elsevier Scientific Publishing Company, 1978 (498 pages).

J. Lee, J. Michaels and R. DiFoggio, "Using PV Tests for Bubble Point Pressures and Quality Control," SPWLA 44th Annual Logging Symposium, Jun. 22-25, 2003, Paper HH.

J. H. Dymond, R. Malhocra, "The Tait Equation: 100 Years on," International Journal of Thermophysics, vol. 9, No. 6, 1988, p. 941-951.

A. T. J. Hayward, "Compressibility Equation for Liquids: A Comparative Study," British J. Applied Physics, vol. 18, 1967, p. 965-977.

R. Lundstrum, A. R. H. Goodwin, K. Hsu, D. R. Caudwell, J. P. M. Trusler, K. Marsh, "Measurements of the Viscosity and Density of Two Reference Fluids with Nominal Viscosities at T=298 K and p=0.1 MPa at Temperatures between (298 and 393) K and Pressures below 55 MPa," J. Chem. Eng. Data, vol. 50, 2005, p. 1377-1388.

B. Le Neindre and R. Tufeu, Application of the Tait Equation to the Determination of Termophysical Properties of Fluids Under Pressure, Proc. Int. CODATA Conference, Kyoto, 1981, p. 411-414.

* cited by examiner

DOWNHOLE CHARACTERIZATION OF FLUID COMPRESSIBILITY

CROSS REFERENCE TO RELATED APPLICATIONS

This application claims priority to and the benefit of Provisional Patent Application No. 62/336,434, entitled "Characterization of Fluid Density and Compressibility Using Downhole Sensors," filed 13 May 2016, which is hereby incorporated by reference in its entirety.

BACKGROUND

This disclosure relates to determining one or more fluid properties of native reservoir fluids downhole.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

Reservoir fluid analysis may be used to better understand a hydrocarbon reservoir in a geological formation. Indeed, reservoir fluid analysis may be used to measure and model fluid properties within the reservoir to determine a quantity and/or quality of formation fluids—such as liquid and/or gas hydrocarbons, condensates, drilling muds, and so forth—that may provide much useful information about the reservoir. This may allow operators to better assess the economic value of the reservoir, obtain reservoir development plans, and identify hydrocarbon production concerns for the reservoir. Numerous possible reservoir models may be used to describe the reservoir. For a given reservoir, however, different possible reservoir models may have varying degrees of accuracy. The accuracy of the reservoir model may impact plans for future well operations, such as enhanced oil recovery, logging operations, and dynamic formation analyses. As such, the more accurate the reservoir model, the greater the likely value of future well operations to the operators producing hydrocarbons from the reservoir.

SUMMARY

This summary is provided to introduce a selection of concepts that are further described below in the detailed description. This summary is not intended to identify key or essential features of the subject matter described herein, nor is it intended to be used as an aid in limiting the scope of the subject matter described herein. Indeed, this disclosure may encompass a variety of aspects that may not be set forth below.

In one example, a method includes operating a downhole acquisition tool in a wellbore in a geological formation. The wellbore or the geological formation, or both, contain a reservoir fluid. The method also includes receiving a portion of the reservoir fluid into the downhole acquisition tool and performing downhole fluid analysis using the downhole acquisition tool in the wellbore to determine at least one measurement associated with the portion of the reservoir fluid. The at least one measurement includes fluid density, optical density, or both. The method also includes using a processor of the downhole acquisition tool to obtain compressibility of the reservoir fluid based at least in part on the fluid density, the optical density, or both and determining a composition of the reservoir fluid based at least in part on the compressibility.

In another example, one or more tangible, non-transitory, machine-readable media includes instructions to receive a fluid parameter of a portion of fluid as analyzed by a downhole acquisition tool in a wellbore in a geological formation. The wellbore or the geological formation, or both, contains the fluid and the fluid parameter includes a measured fluid density, an optical density, or both of the portion of the fluid. The one or more tangible, non-transitory, machine-readable media also includes instructions to estimate a compressibility of the portion of the fluid based at least in part on a fluid density, the optical density, or both of the portion of the fluid and to determine a composition of the reservoir fluid based at least in part on the compressibility.

In another example, a system, includes a downhole acquisition tool housing having a sensor that may measure at least one fluid property of a reservoir fluid within a geological formation of a hydrocarbon reservoir and a data processing system having one or more tangible, non-transitory, machine-readable media having instructions to receive the at least one fluid property of the reservoir fluid as analyzed by the downhole acquisition tool. The fluid comprises a gas, oil, water, or a combination thereof. The one or more tangible, non-transitory, machine-readable media also includes instructions to estimate a compressibility of the reservoir fluid based at least in part on the at least one fluid property. The fluid property includes a fluid density, the optical density, or both of the portion of the fluid. The one or more tangible, non-transitory, machine-readable media also includes instructions to determine a composition of the reservoir fluid based at least in part on the compressibility.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
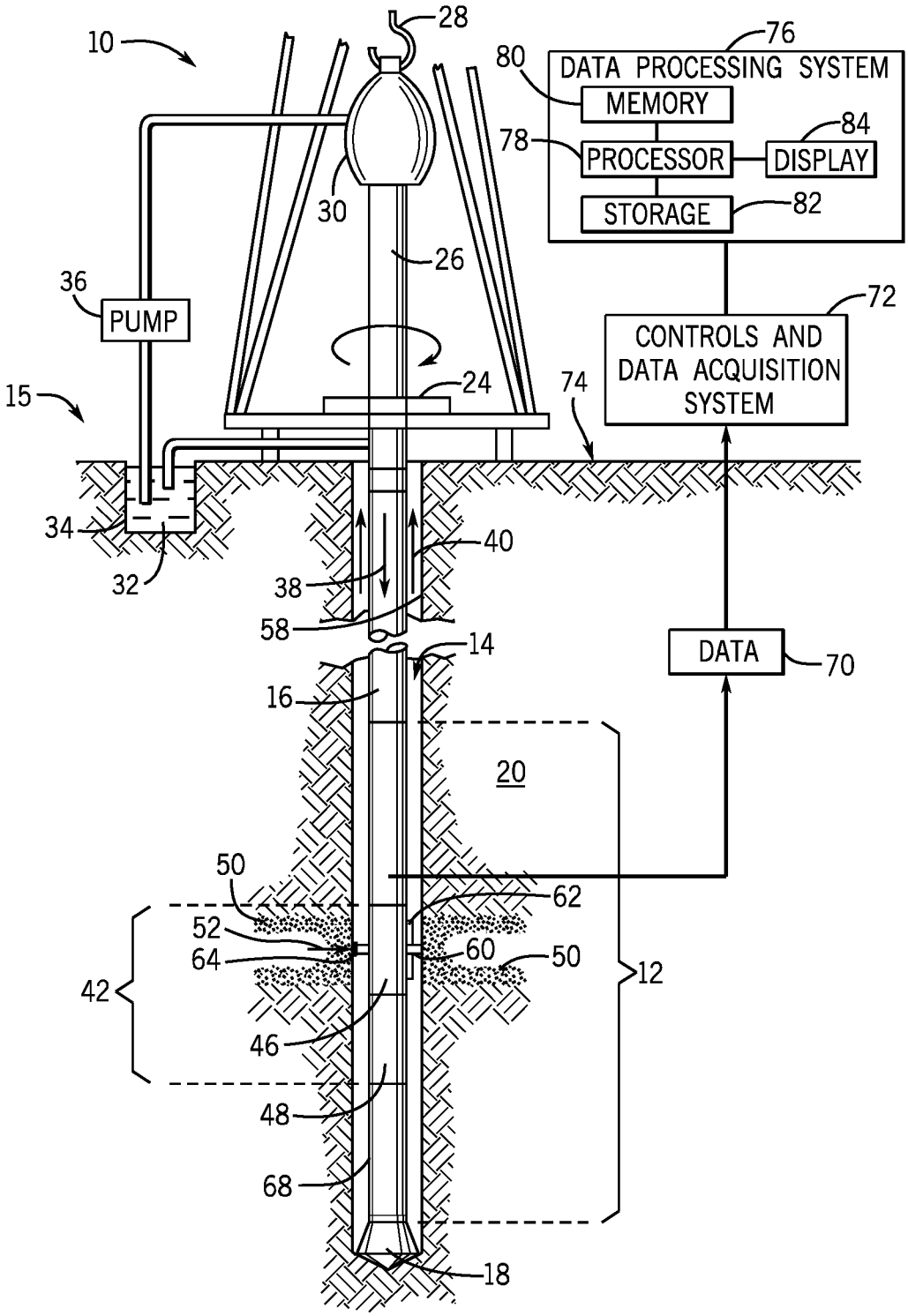
FIG. 1 is a schematic diagram of a wellsite system that may employ downhole fluid analysis for determining fluid properties of a reservoir, in accordance with an embodiment.

One or more specific embodiments of the present disclosure will be described below. These described embodiments are examples of the presently disclosed techniques. Additionally, in an effort to provide a concise description of these embodiments, features of an actual implementation may not be described in the specification. It should be appreciated that in the development of any such actual implementation, as in any engineering or design project, numerous implementation-specific decisions may be made to achieve the developers' specific goals, such as compliance with system-related and business-related constraints, which may vary from one implementation to another. Moreover, it should be appreciated that such a development effort might be complex and time consuming, but would still be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Acquisition and analysis representative of formation fluids downhole in delayed or real time may be use in reservoir modeling. A reservoir model based at least in part on downhole fluid analysis may predict or explain reservoir characteristics such as, but not limited to, connectivity, productivity, lifecycle stages, type and timing of hydrocarbon, hydrocarbon contamination, and reservoir fluid dynamics. In addition, the reservoir model based at least in part on downhole fluid analysis may be used to determine the primary (e.g., dominant) fluid type (e.g., oil, gas, water) present in a wellbore of interest. For example, reservoir fluids may contain a mixture of oil, gas, and water. The oil, gas, and water each have a different compressibility. Therefore, a compressibility of the reservoir fluid may change based at least in part on an amount of oil, gas, and/or water present in the reservoir fluid. However, the compressibility of the reservoir fluid varies based at least in part on pressure and temperature. Accordingly, it may be desirable to determine the compressibility of the reservoir fluid at wellbore pressures and temperatures to improve the accuracy of fluid characterization using downhole fluid analysis. Equation of state models may be used to characterize reservoir fluids over a wide pressure and temperature range. In particular, the equation of state models may include the Tait equation, which may be used to model and describe fluid properties as a function of pressure and/or temperature and provide an indication of the dominant fluid type (e.g., oil, gas, water) in the reservoir fluid. EOS models for compressibility, such as the Tait equation, rely on pressure and volume data. However, while EOS models for compressibility account for expansion of the reservoir fluid under pressure, the EOS models may not account for volume expansion due to compliance of material and elastomeric seals positioned along a flowline of the downhole acquisition tool. As such, compressibility data derived from EOS models that rely on volume may be inaccurate. Accordingly, embodiments of the present disclosure include a compressibility model derived from a modified Tait equation that does not rely on volume that may be used model and estimate compressibility of the reservoir fluids. Rather, the compressibility model is defined in terms of pressure and optical density of the reservoir fluid. In this way, the accuracy of the compressibility data associated with the reservoir fluid may be improved.

Figure 2:
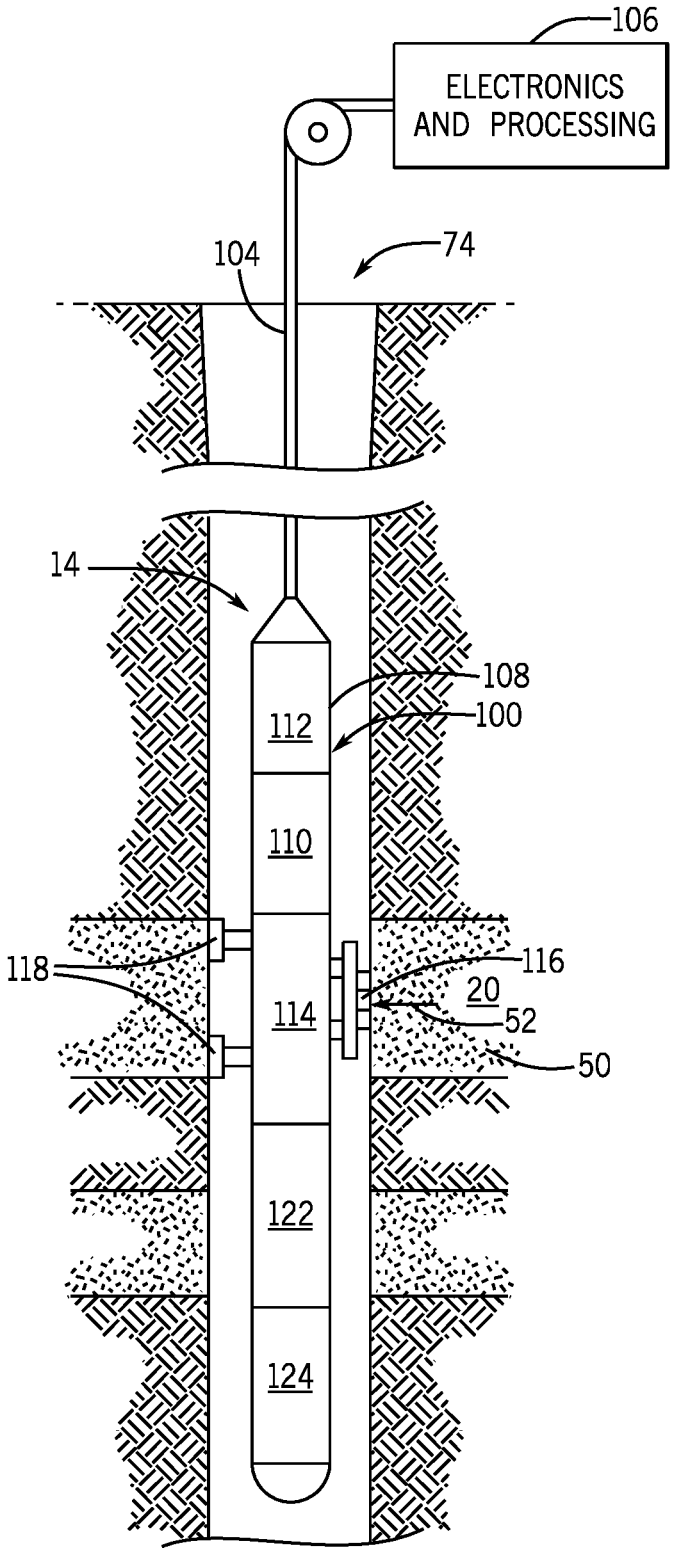
FIG. 2 is a schematic diagram of another embodiment of a wellsite system that may employ downhole fluid analysis methods for determining fluid properties and formation characteristics within a wellbore, in accordance with an embodiment.

FIGS. 1 and 2 depict examples of wellsite systems that may employ the fluid analysis systems and techniques described herein. FIG. 1 depicts a rig 10 with a downhole acquisition tool 12 suspended therefrom and into a wellbore 14 of a reservoir 15 via a drill string 16. The downhole acquisition tool 12 has a drill bit 18 at its lower end thereof that is used to advance the downhole acquisition tool 12 into geological formation 20 and form the wellbore 14. The drill string 16 is rotated by a rotary table 24, energized by means not shown, which engages a kelly 26 at the upper end of the drill string 16. The drill string 16 is suspended from a hook 28, attached to a traveling block (also not shown), through the kelly 26 and a rotary swivel 30 that permits rotation of the drill string 16 relative to the hook 28. The rig 10 is depicted as a land-based platform and derrick assembly used to form the wellbore 14 by rotary drilling. However, in other embodiments, the rig 10 may be an offshore platform.

Drilling fluid or mud 32 (e.g., oil base mud (OBM) or water-based mud (WBM)) is stored in a pit 34 formed at the well site. A pump 36 delivers the drilling fluid 32 to the interior of the drill string 16 via a port in the swivel 30, inducing the drilling mud 32 to flow downwardly through the drill string 16 as indicated by a directional arrow 38. The drilling fluid exits the drill string 16 via ports in the drill bit 18, and then circulates upwardly through the region between the outside of the drill string 16 and the wall of the wellbore 14, called the annulus, as indicated by directional arrows 40. The drilling mud 32 lubricates the drill bit 18 and carries formation cuttings up to the surface as it is returned to the pit 34 for recirculation.

The downhole acquisition tool 12, sometimes referred to as a bottom hole assembly ("BHA"), may be positioned near the drill bit 18 and includes various components with capabilities, such as measuring, processing, and storing information, as well as communicating with the surface. A telemetry device (not shown) also may be provided for communicating with a surface unit (not shown). As should be noted, the downhole acquisition tool 12 may be conveyed on wired drill pipe, a combination of wired drill pipe and wireline, or other suitable types of conveyance.

In certain embodiments, the downhole acquisition tool 12 includes a downhole fluid analysis system. For example, the downhole acquisition tool 12 may include a sampling system 42 including a fluid communication module 46 and a sampling module 48. The modules may be housed in a drill collar for performing various formation evaluation functions, such as pressure testing and fluid sampling, among others. As shown in FIG. 1, the fluid communication module 46 is positioned adjacent the sampling module 48; however the position of the fluid communication module 46, as well as other modules, may vary in other embodiments. Additional devices, such as pumps, gauges, sensor, monitors or other devices usable in downhole sampling and/or testing also may be provided. The additional devices may be incorporated into modules 46, 48 or disposed within separate modules included within the sampling system 42.

The downhole acquisition tool 12 may evaluate fluid properties of reservoir fluid 50. Accordingly, the sampling system 42 may include sensors that may measure fluid properties such as gas-to-oil ratio (GOR), mass density, optical density (OD), composition of carbon dioxide ($CO_2$), $C_1$, $C_2$, $C_3$, $C_4$, $C_5$, and $C_{6+}$, formation volume factor, viscosity, resistivity, fluorescence, American Petroleum Institute (API) gravity, and combinations thereof of the reservoir fluid 50. The fluid communication module 46 includes a probe 60, which may be positioned in a stabilizer blade or rib 62. The probe 60 includes one or more inlets for receiving the formation fluid 52 and one or more flow lines (not shown) extending into the downhole acquisition tool 12 for passing fluids (e.g., the reservoir fluid 50) through the tool. In certain embodiments, the probe 60 may include a single inlet designed to direct the reservoir fluid 50 into a flowline within the downhole acquisition tool 12. Further, in other embodiments, the probe 60 may include multiple inlets that may, for example, be used for focused sampling. In these embodiments, the probe 60 may be connected to a sampling flow line, as well as to guard flow lines. The probe 60 may be movable between extended and retracted positions for selectively engaging the wellbore wall 58 of the wellbore 14 and acquiring fluid samples from the geological formation 20. One or more setting pistons 64 may be provided to assist in positioning the fluid communication device against the wellbore wall 58.

In certain embodiments, the downhole acquisition tool 12 includes a logging while drilling (LWD) module 68. The module 68 includes a radiation source that emits radiation (e.g., gamma rays) into the formation 20 to determine formation properties such as, e.g., lithology, density, formation geometry, reservoir boundaries, among others. The gamma rays interact with the formation through Compton scattering, which may attenuate the gamma rays. Sensors within the module 68 may detect the scattered gamma rays and determine the geological characteristics of the formation 20 based at least in part on the attenuated gamma rays.

The sensors within the downhole acquisition tool 12 may collect and transmit data 70 (e.g., log and/or DFA data) associated with the characteristics of the formation 20 and/or the fluid properties and the composition of the reservoir fluid 50 to a control and data acquisition system 72 at surface 74, where the data 70 may be stored and processed in a data processing system 76 of the control and data acquisition system 72.

The data processing system 76 may include a processor 78, memory 80, storage 82, and/or display 84. The memory 80 may include one or more tangible, non-transitory, machine readable media collectively storing one or more sets of instructions for operating the downhole acquisition tool 12, determining formation characteristics (e.g., geometry, connectivity, etc.) calculating and estimating fluid properties of the reservoir fluid 50, modeling the fluid behaviors using, e.g., equation of state models (EOS). The memory 80 may store reservoir modeling systems (e.g., geological process models, petroleum systems models, reservoir dynamics models, etc.), mixing rules and models associated with compositional characteristics of the reservoir fluid 50, equation of state (EOS) models for equilibrium and dynamic fluid behaviors (e.g., biodegradation, gas/condensate charge into oil, $CO_2$ charge into oil, fault block migration/subsidence, convective currents, among others), and any other information that may be used to determine geological and fluid characteristics of the formation 20 and reservoir fluid 52, respectively. In certain embodiments, the data processing system 54 may apply filters to remove noise from the data 70.

To process the data 70, the processor 78 may execute instructions stored in the memory 80 and/or storage 82. For example, the instructions may cause the processor to compare the data 70 (e.g., from the logging while drilling and/or downhole fluid analysis) with known reservoir properties estimated using the reservoir modeling systems, use the data 70 as inputs for the reservoir modeling systems, and identify geological and reservoir fluid parameters that may be used for exploration and production of the reservoir. As such, the memory 80 and/or storage 82 of the data processing system 76 may be any suitable article of manufacture that can store the instructions. By way of example, the memory 80 and/or the storage 82 may be ROM memory, random-access memory (RAM), flash memory, an optical storage medium, or a hard disk drive. The display 84 may be any suitable electronic display that can display information (e.g., logs, tables, cross-plots, reservoir maps, etc.) relating to properties of the well/reservoir as measured by the downhole acquisition tool 12. It should be appreciated that, although the data processing system 76 is shown by way of example as being located at the surface 74, the data processing system 76 may be located in the downhole acquisition tool 12. In such embodiments, some of the data 70 may be processed and stored downhole (e.g., within the wellbore 14), while some of the data 70 may be sent to the surface 74 (e.g., in real time). In certain embodiments, the data processing system 76 may use information obtained from petroleum system modeling operations, ad hoc assertions from the operator, empirical historical data (e.g., case study reservoir data) in combination with or lieu of the data 70 to determine certain parameters of the reservoir 8.

FIG. 2 depicts an example of a wireline downhole tool 100 that may employ the systems and techniques described herein to determine formation and fluid property characteristics of the reservoir 8. The downhole tool 100 is suspended in the wellbore 14 from the lower end of a multi-conductor cable 104 that is spooled on a winch at the surface 74. Similar to the downhole acquisition tool 12, the wireline downhole tool 100 may be conveyed on wired drill pipe, a combination of wired drill pipe and wireline, or other suitable types of conveyance. The cable 104 is communicatively coupled to an electronics and processing system 106. The downhole tool 100 includes an elongated body 108 that houses modules 110, 112, 114, 122, and 124 that provide various functionalities including imaging, fluid sampling, fluid testing, operational control, and communication, among others. For example, the modules 110 and 112 may provide additional functionality such as fluid analysis, resistivity measurements, operational control, communications, coring, and/or imaging, among others.

As shown in FIG. 2, the module 114 is a fluid communication module 114 that has a selectively extendable probe 116 and backup pistons 118 that are arranged on opposite sides of the elongated body 108. The extendable probe 116 is configured to selectively seal off or isolate selected portions of the wall 58 of the wellbore 14 to fluidly couple to the adjacent geological formation 20 and/or to draw fluid samples from the geological formation 20. The probe 116 may include a single inlet or multiple inlets designed for guarded or focused sampling. The reservoir fluid 50 may be expelled to the wellbore through a port in the body 108 or the formation fluid 50 may be sent to one or more fluid sampling modules 122 and 124. The fluid sampling modules 122 and 124 may include sample chambers that store the reservoir fluid 50. In the illustrated example, the electronics and processing system 106 and/or a downhole control system are configured to control the extendable probe assembly 116 and/or the drawing of a fluid sample from the formation 20 to enable analysis of the fluid properties of the reservoir fluid 50, as discussed above.

As discussed above, fluid properties as a function of pressure, volume, and temperature (PVT), may be used to determine certain characteristics of downhole fluids (e.g., the fluid 50, 52). For example, the pressure, volume, and temperature of the formation fluid 52 may be used to estimate a compressibility of the reservoir fluid 50, which may provide an indication of the dominant fluid-type (e.g., oil, gas, or water) present in the reservoir fluid 50. However, the compressibility of the reservoir fluid 50 changes based at least in part on a pressure and temperature of the fluid at the time of analysis. Therefore, during in situ analysis of the formation fluid 52 using the downhole acquisition tool 12, a sampled volume of the formation fluid 52 is trapped in a closed system during isothermal depressurization (or pressurization) to maintain the formation fluid 52 at the desired pressure (e.g., a pressure that is substantially equal to a pressure of the reservoir fluid 50 before sampling (or wellbore pressure)) and temperature for analysis.

In certain downhole fluid analysis techniques, the compressibility of the fluid may then be determined according to the compressibility equation expressed as follows:

$$c = \frac{1}{V}\left(\frac{dV}{dp}\right)_T = \left(\frac{d\ln V}{dp}\right)_T \quad \text{(EQ. 1)}$$

where c is the compressibility of the fluid, v is the volume of the fluid, and p is the pressure exerted by the fluid.

However, because EQ. 1 is defined in terms of pressure and volume, obtaining an accurate measure of compressibility of the reservoir fluid using EQ. 1 depends on the accuracy of the volume used to calculate the compressibility. Obtaining an accurate measure of volume of the reservoir fluid may be difficult due, in part, to pressure-dependent finite compliance of the material from the flowline loop and expansion of elastomeric seals along the flowline. For example, expansion of the finite compliance of material and the elastomeric seals may occupy a volume, in addition to a volume of the reservoir fluid, within the closed system. The additional volume resulting from expansion of the finite compliance of material and the elastomeric seals is generally not considered in estimating the compressibility of the reservoir fluid using EQ. 1. Accordingly, the volume used to estimate the compressibility of the reservoir fluid using EQ. 1 may be inaccurate. Consequently, the estimated compressibility of the reservoir fluid may also be inaccurate. However, it is now recognized that by using fluid density (ρ) and/or optical density (OD) data, rather than fluid volume, to determine the compressibility of the reservoir fluid 50, the accuracy of the compressibility determined by downhole fluid analysis using the downhole acquisition tool 12 may be improved.

Figure 3:
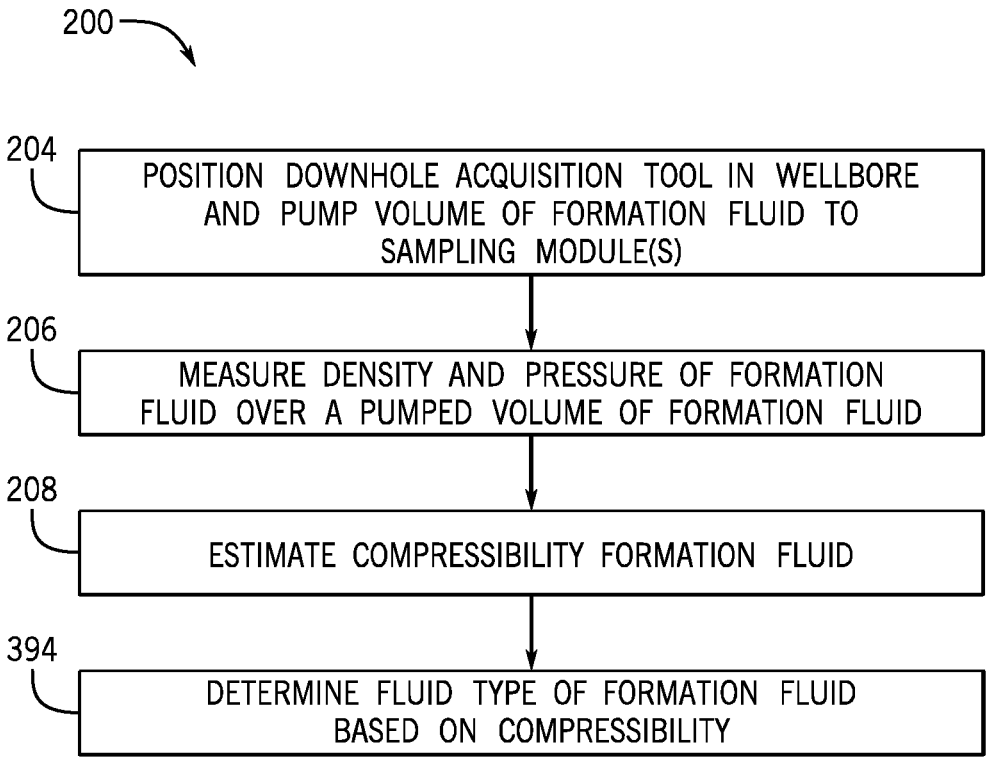
FIG. 3 is flowchart of an embodiment of a method that determines compressibility of a formation fluid using a compressibility model that includes fluid density, optical density, or both of the formation fluid.

A method for determining the compressibility of the reservoir fluid 50 using optical density (OD) and/or fluid density data obtain in situ in real-time with the downhole acquisition tool 12 is illustrated in flowchart 200 of FIG. 3. In the illustrated flowchart 200, the downhole acquisition tool 12 is positioned at a desired depth within the wellbore 14 and a volume of the formation fluid 52 is directed to the sampling modules (e.g., modules 48, 122, 124) for analysis (block 204). For example, the downhole acquisition tool 12 is lowered into the wellbore 14, as discussed above, such that the probe 60, 116 is within a fluid sampling region of interest. The probe 60, 116 faces toward the geological formation 20 to enable a flow of the formation fluid 52 through the flowline toward the sampling modules 48, 122, 124.

While in the downhole acquisition tool 12, the multiple sensors detect and transmit the measurements (e.g., the data 70) of the formation fluid 52 such as, but not limited to, density (ρ), composition, optical density (OD), temperature (T), pressure (P), and any other suitable parameters of the formation fluid 52 to the data processing system 76. In one embodiment, the downhole acquisition tool 12 measures the fluid density, OD, pressure, and/or temperature of the fluid 52 over a pumped volume of the formation fluid 52 (block 206). As discussed above, the optical density of the formation fluid 52 may be used to determine the compressibility of the formation fluid 52 as a function of pressure and temperature using a compressibility model derived from the modified Tait equation. By using the OD of the formation fluid 52 to determine the compressibility, the dominant fluid (e.g., oil, gas, water) present in the formation fluid 52 may be determined with improved accuracy compared to methods that rely on the volume of the formation fluid sampled.

As discussed above, downhole monitoring of fluid compressibility does not account for pressure-dependent expansion of the finite compliance of the materials and the elastomeric seals along the flowline of the downhole acquisition tool 12, which may result in inaccurate compressibility measurements. However, the embodiments disclosed herein rely on fluid density and OD measurements to determine the compressibility of the formation fluid. Therefore, without the disclosed embodiments, compressibility measurements of the formation fluid 52 may be inaccurate. As such, it may be difficult to determine a composition of the formation fluid 52 in real time.

However, it is now recognized that the compressibility equation expressed in EQ. 1 above may be modified to integrate fluid properties (e.g., fluid density and/or optical density) into the equation to allow characterization of fluid compressibility as a function of pressure and/or temperature rather than as a function of pressure, temperature, and volume. In this way, the fluid compressibility estimates determined using the downhole acquisition tool 12 may not be affected by the volume changes resulting from expansion of the finite compliance of material and elastomeric seals along the flowline may. Accordingly, the flowchart 200 of FIG. 3 includes estimating the fluid compressibility of the formation fluid 52 as a function of pressure and temperature using the optical density, the fluid density, or both, as measured by the downhole acquisition tool 12 (block 208).

The fluid compressibility of the reservoir fluid 50 may be derived from fluid density data obtained by the downhole acquisition tool 12 as a function of pressure using the following relationship:

$$c = \frac{1}{\rho}\left(\frac{d\rho}{dp}\right)_T = \left(\frac{d\ln\rho}{dp}\right)_T \quad \text{(EQ. 2)}$$

where ρ is the fluid density, p is the pressure of the reservoir fluid, and T is the temperature of the reservoir fluid. As discussed in further detail below, the fluid density (ρ) has a linear relationship with the optical density (OD) of the reservoir fluid 50. Accordingly, EQ. 2 may be used to derive a model for determining the compressibility of the reservoir fluid 50 based at least in part on a compressibility model that integrates the fluid density and the OD of the reservoir fluid 50 as a function of pressure and/or temperature.

For example, the compressibility model may be used to predict (estimate) the fluid density of a single phase fluid (e.g., oil, gas, water) and mixtures of fluids (e.g., a mixture of oil, gas, and water) up to an elevated pressure or over a wide pressure range. In an isothermal conditions, the density model (e.g., modified Tait equation) may model the fluid density of the reservoir fluid 50 according to the following relationship:

$$\frac{\rho-\rho_0}{\rho}=C\log\frac{B+P}{B+P_0} \quad \text{(EQ. 3)}$$

where ρ is the fluid density, $\rho_0$ is the fluid density at saturation pressure (or at a pressure slightly above saturation pressure) of the single phase fluid, P is the pressure of the fluid, and $P_0$ is the saturation pressure (or a pressure slightly above the saturation pressure). The terms B and C are unknown parameters that may be estimated from fitting isothermal vs density data.

EQ. 3 may be used to model fluid density as a function of pressure under isothermal condition. However, EQ. 3 may also be extended to model the fluid density as a function of both pressure and temperature. The density of the reservoir fluid 50 may be affected by both the pressure and the temperature. Therefore, it may be desirable to model the density of the reservoir fluid 50 as a function of both the pressure and the temperature. This may be achieved by representing B as a function of temperature as follows:

$$B=A_0+A_1T+A_2T^2 \quad \text{(EQ. 4)}$$

where T is the temperature of the fluid, $A_0$, $A_1$, and $A_2$ are unknown parameters that may be determined by fitting density vs pressure and temperature data using EQs. 3 and 4. Fitting the density vs pressure and temperature data may be done by using known algorithms, such as the Levenberg-Marquardt algorithm.

The Levenberg-Marquardt algorithm may be used in least squared curve fitting applications. Least squared fitting is based at least in part on the concept that an optimum characterization of a set of data is one that minimized the sum of the squares of the deviation of the data from the fitting model, such as the models expressed in EQ. 3 and 4. The Levenberg-Marquardt algorithm may be used to determine the unknown parameters which minimize the chi-square measure ($\chi^2$). For example, the unknown parameters C, B, A0, $A_1$, and $A_2$ may be determined according to the following relationship:

$$X^2=\frac{\sum_{i=1}^{N}\left|\rho_i-\rho_0\left(1-C\log\left(\frac{B(T_i)+P_i}{B(T_2)+P_0}\right)\right)^{-1}\right|^2}{v} \quad \text{(EQ. 5)}$$

where $\rho_i$, $T_i$, and $P_i$ are density, temperature, and pressure data, respectively, as measured by the downhole acquisition tool 12, and v is the number of degrees of freedom for fitting N data points. In an isothermal condition, B may be treated as an unknown parameter that may be estimated along with C by the following relationship:

$$\min_{C,B} X^2(C,B) \quad \text{(EQ. 6)}$$

In certain embodiments, for example when the density vs pressure and temperature data are available, the unknown parameters C, $A_0$, $A_1$, and $A_2$ may be estimated by the following relationship:

$$\min_{C,A_0,A_1,A_2} X^2(C,A_0,A_1,A_2) \quad \text{(EQ. 7)}$$

If the density data is acquired in a closed system the relationships expressed in EQs. 2, 3 and 5 may be used derived the compressibility of the reservoir fluid 50 based at least in part on the compressibility model expressed as follows:

where the unknown parameters C and B (or C, $A_0$, $A_1$, and $A_2$) are determined by fitting the density data using the EQs 3 and 4.

As discussed above, the fluid density has a linear relationship with optical density. For example, Beer-Lamberts law relates the fluid density to the optical density according to the following relationship:

$$\text{OD}=m\rho \quad \text{(EQ. 9)}$$

where OD is the optical density of the reservoir fluid 50 at a particular wavelength (e.g., a wavelength in the near infrared (NIR)), ρ is the fluid density, and m is an unknown constant related to the absorption coefficient of the reservoir fluid 50 measured at a particular wavelength. The OD of the reservoir fluid 50 is mathematically defined as follows:

where I is the transmitted light intensity at a desired wavelength and $I_0$ is the reference light intensity measured at the same wavelength as the transmitted light intensity. Due to the linear relationship between fluid density and OD, EQ. 3 may be expressed in terms of OD rather than fluid density by substituting EQ. 9 into EQ. 3, resulting in the following relationship:

$$\frac{OD-OD_0}{OD}=C\log\left(\frac{B+P}{B+P_0}\right) \quad \text{(EQ. 11)}$$

where $OD_0$ is the optical density measured at the saturation pressure $P_0$ of the reservoir fluid 50 at the same wavelength as OD. Processed OD and $OD_0$, including offset removed OD may be used in EQ. 11. The processed OD is simply obtained by subtracting OD at a different wavelength from OD measured at a particular wavelength. EQ. 11 may be integrated into the compressibility model expressed above (EQ. 8), thereby fitting the OD data acquired by the downhole acquisition tool 12 as a function of pressure and temperature. By using the OD of the reservoir fluid 50 to determine the compressibility, the signal-to-noise ratio (S/N) may be improved. Additionally, by using the OD to determine compressibility of the reservoir fluid 50, a wider dynamic pressure range representative of downhole conditions may be modeled to determine a fluid type (e.g., gas, gas condensate, volatile oil, black oil, heavy oil, and water) of the reservoir fluid 50 at downhole pressures and temperatures that may otherwise be unattainable.

A table of example cases, along with laboratory-measured gas-to-oil ratio (GOR), specific gravity (API), bubble point, viscosity, and fluid density for gas condensate and black oil is shown below. The data was measured in a remote Pressure, Volume, Temperature (PVT) Laboratory using standard laboratory procedures. The live formation fluids were sampled using a downhole PVT module that captures live formation fluid in a by-pass flow loop. The sampled live formation fluid may undergo a constant composition expansion by depressurizing the fluid sample with a pressure-volume control unit. Fluid sensors positioned along the flow loop include a pressure/temperature gauge for measuring the pressure and temperature of the live formation fluid, a density-viscosity (DV) rod for measuring the fluid density and viscosity, and an optical scattering detector having a single channel spectrometer used to detect the saturation pressure during depressurization. The viscosity and density ranges shown below was determined over a test pressure range.

TABLE 1

Live Formation Fluid Properties Obtained in PVT Laboratory

| Fluid | GOR (scf/stb) | API | Bubble point (psi) | Dew point (psi) | Viscosity (cp) | Density (g/cc) |
|---|---|---|---|---|---|---|
| Gas condensate | 9630 | 52.6 | — | 6760 | 0.05-0.07 | 0.38-0.44 |
| Black oil | 2230 | 31.3 | 7790 | — | 0.35-0.45 | 0.61-0.65 |
| Black oil 2 | 640 | 27.5 | 2543 | — | 0.90-1.30 | 0.73-0.78 |

Figure 4:
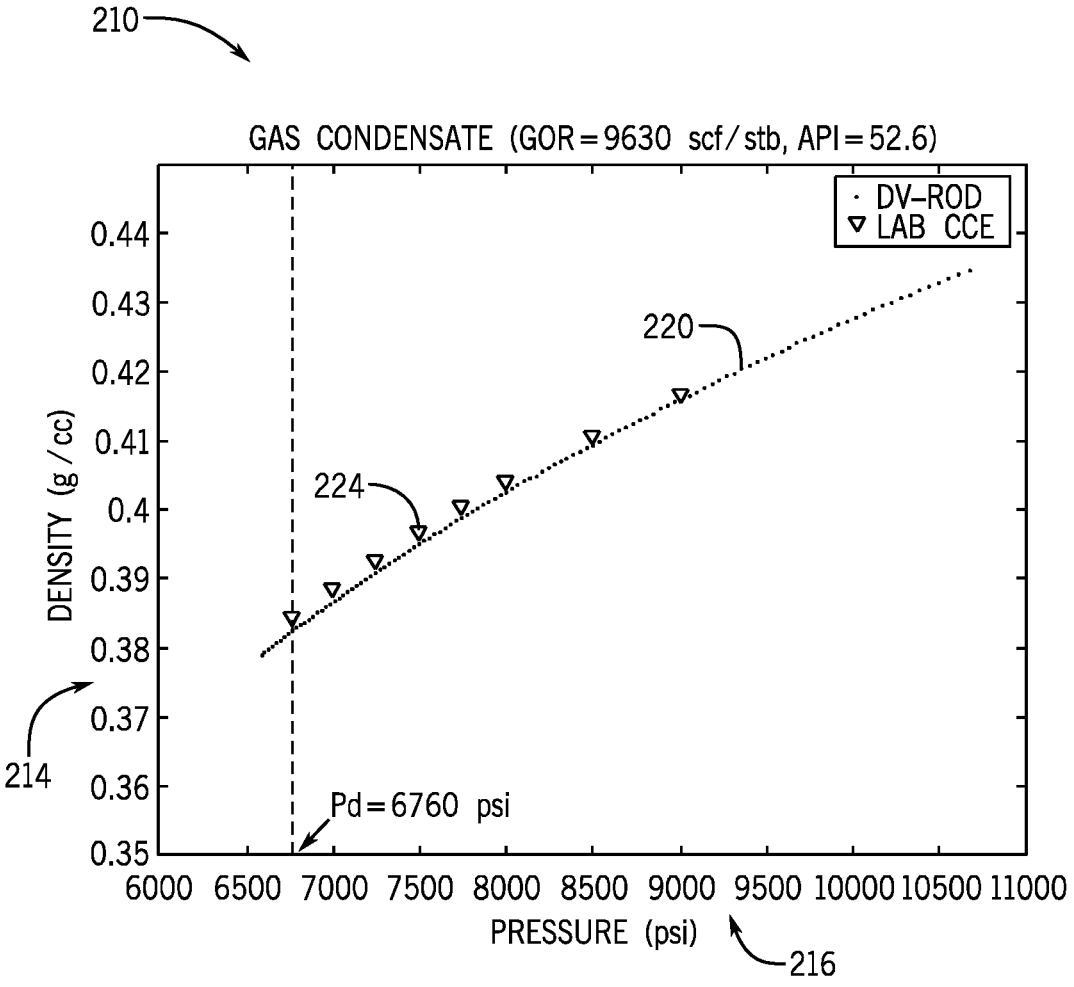
FIG. 4 is a representative plot of measured fluid density as a function of pressure for a formation fluid including gas condensate, in accordance with an embodiment.

The data from the PVT Laboratory was used to validate the EQ. 8 used to determine the fluid compressibility of the live formation fluids using the optical density. The unknown parameters in EQ. 8 were determined by using EQs. 3 or 11 based on either fluid density or optical density, respectively. For example, FIG. 4 shows a plot 210 of density 214 (grams/cubic centimeter (g/cc)) as a function of pressure 216 (pounds per square inch (psi)) for the gas condensate example case listed in Table 1. The plot 210 shows in-situ density data 220 as measured by the downhole acquisition tool 12 and laboratory density data 224 obtained in the PVT laboratory using standard laboratory procedures. As shown in plot 210, the in-situ density data 220 and the laboratory density data 224 are similar. The difference between the data 220 and 224 is less than approximately 0.01 g/cc. Accordingly, the downhole acquisition tool 12 may estimate the in-situ density data 214 of the gas condensate as a function of the pressure 216 with an accuracy similar to the laboratory density data 224 obtained in the PVT laboratory.

Figure 5:
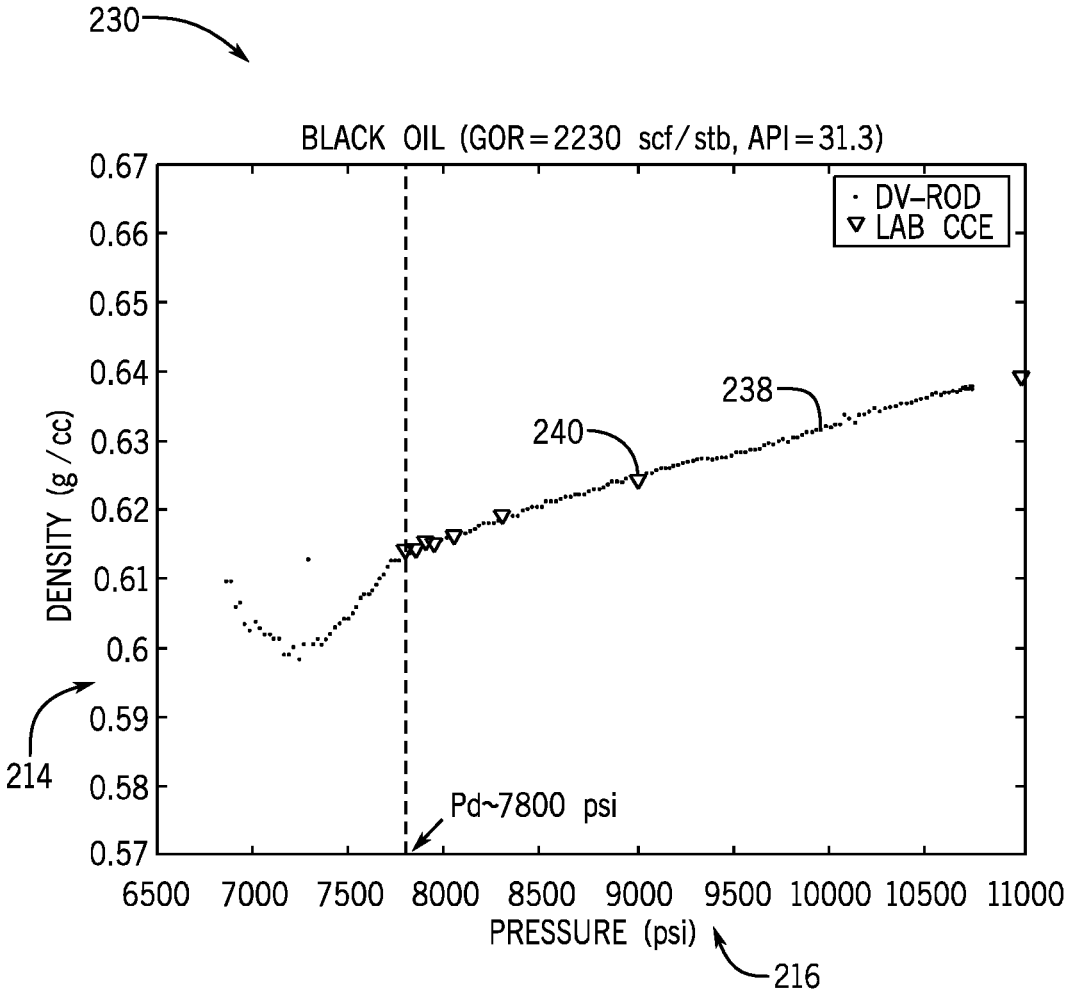
FIG. 5 is a representative plot of measured fluid density as a function of pressure for a formation fluid including black oil, in accordance with an embodiment.
Figure 6:
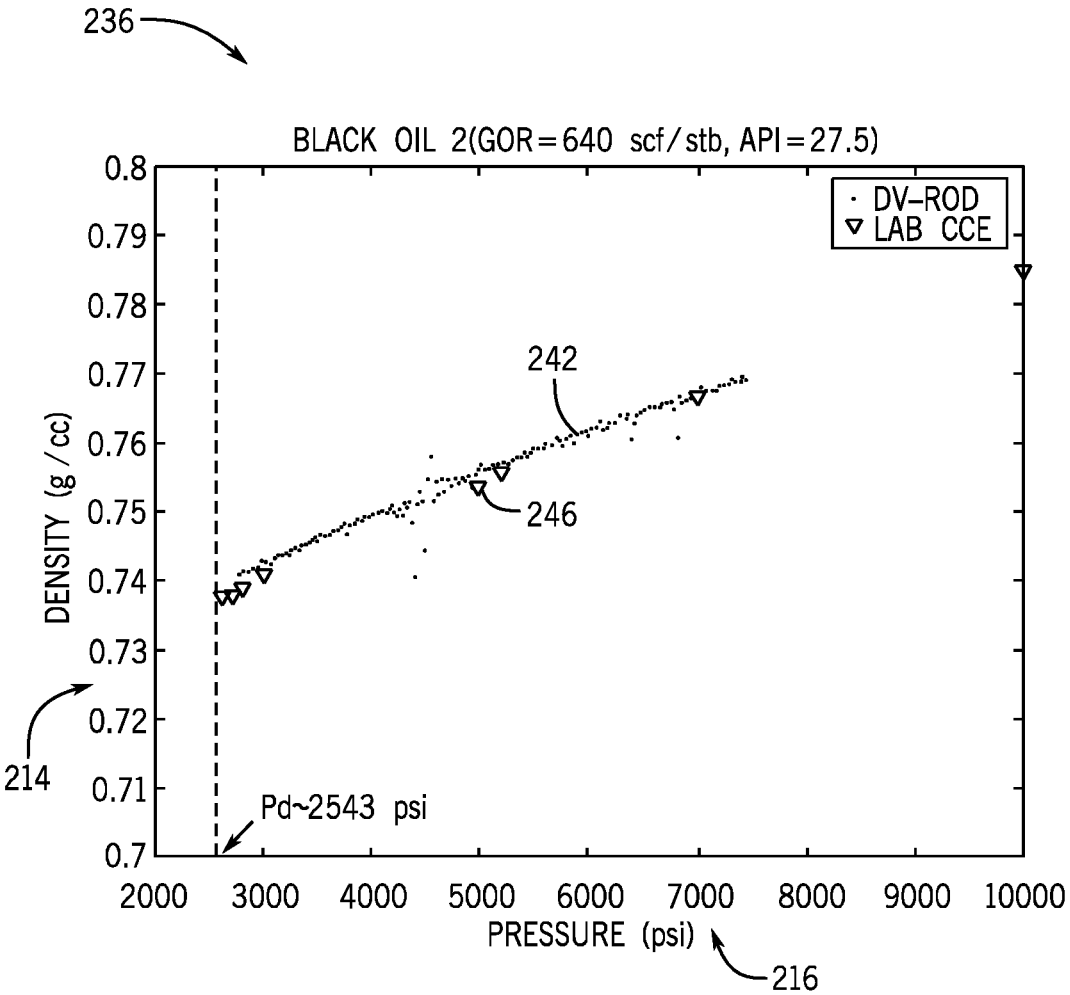
FIG. 6 is a representative plot of measured fluid density as a function of pressure for a formation fluid including black oil having a low gas-to-oil ratio (GOR), in accordance with an embodiment.

Similarly, FIGS. 5 and 6 show plots 230 and 236, respectively, of the density 214 (g/cc) as a function of pressure 216 (psi) for the black oil example case listed in Table 1. Therefore, the in-situ density data 214 may be used to validate the compressibility model shown in EQ. 8. The plot 230 of FIG. 5 shows volatile black oil in-situ density data 238 as measured by the downhole acquisition tool 12 and volatile black oil laboratory density data 240 obtained in the PVT laboratory using standard laboratory procedures. The plot 236 of FIG. 6 shows a low GOR black oil in-situ density data 242 as measured by the downhole acquisition tool 12 and low GOR black oil laboratory density data 246 obtained in the PVT laboratory using standard laboratory procedures. As shown in plots 230, 236, the in-situ density data 238, 242 and the laboratory density data 240, 246 are similar, indicating that the in-situ density data 238, 242 generated by the downhole acquisition tool 12 is comparable to the laboratory density data 240, 246.

Figure 7:
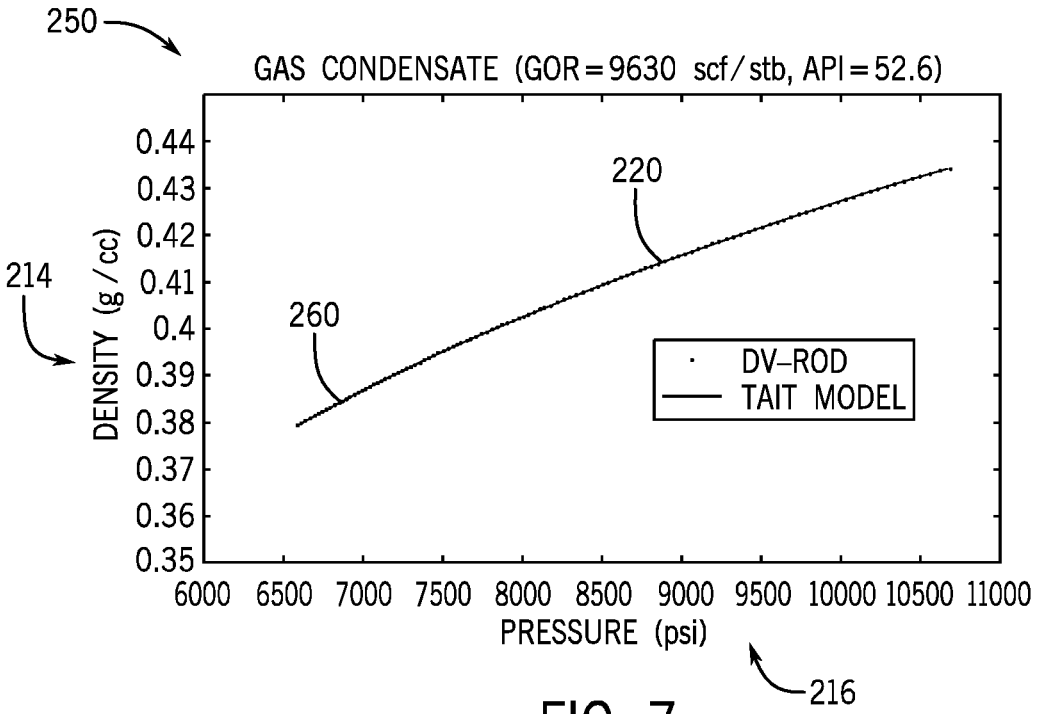
FIG. 7 is a representative plot of fluid density as a function of pressure for the gas condensate in FIG. 4 where fluid density data estimated using the density model fits in-situ fluid density data measured using the downhole acquisition tool of FIG. 1 or 2, in accordance with an embodiment.
Figure 8:
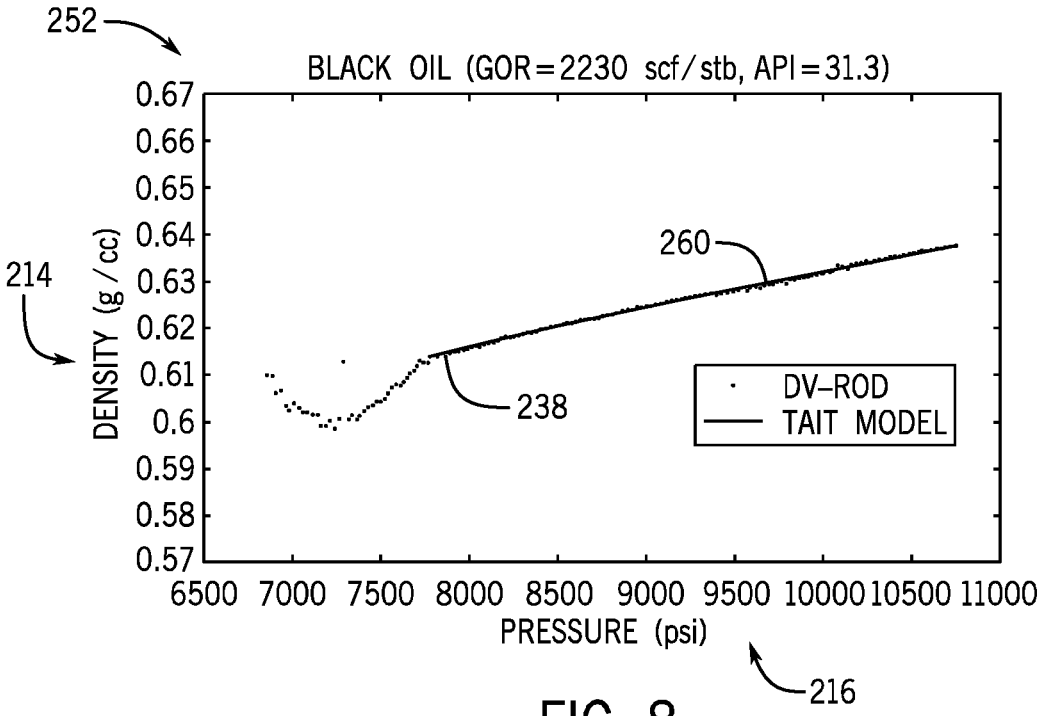
FIG. 8 is a representative plot of fluid density as a function of pressure for the black oil in FIG. 5 where fluid density data estimated using the density model fits in-situ fluid density data measured using the downhole acquisition tool of FIG. 1 or 2, in accordance with an embodiment.
Figure 9:
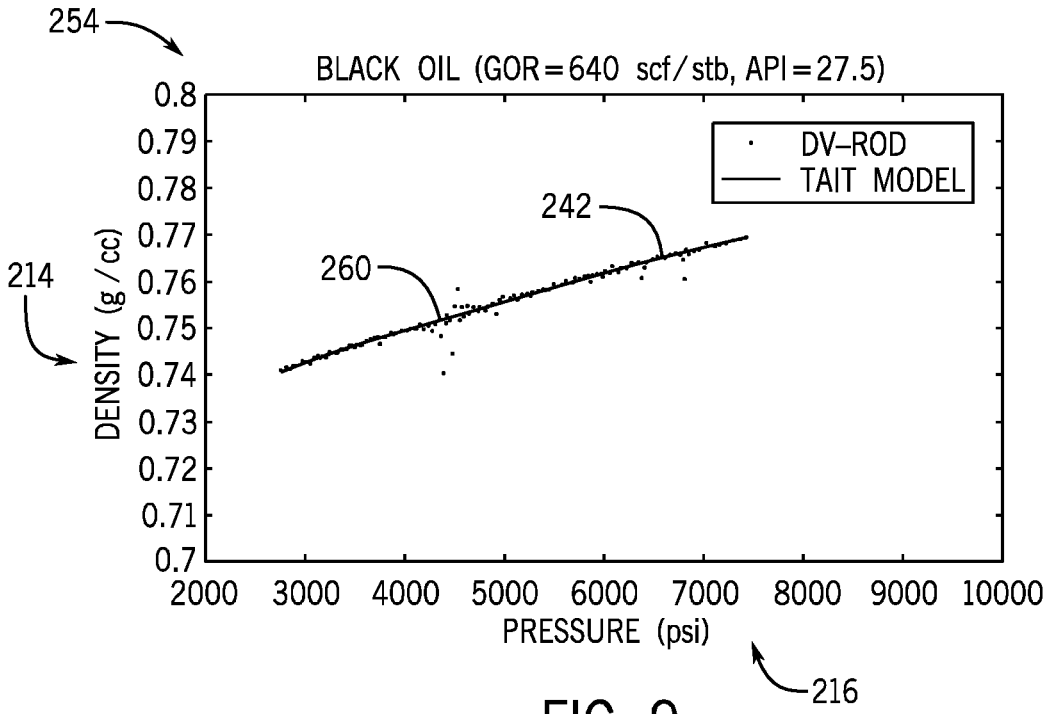
FIG. 9 is a representative plot of fluid density as a function of pressure for the black oil in FIG. 6 where fluid density data estimated using the density model fits in-situ fluid density data measured using the downhole acquisition tool of FIG. 1 or 2, in accordance with an embodiment.

Therefore, the in-situ density data 220, 238, 242 generated by the downhole acquisition tool 12 may be used to derive the compressibility from the compressibility model expressed in EQ. 8 above. For example, FIGS. 7-9 show plots 250, 252, 254 of the density 214 (g/cc) as a function of pressure 216 (psi) for the gas condensate, volatile black oil, and low GOR black oil, respectively, example cases listed in Table 1. density 214 vs pressure 216 data modeled according to the density model expressed in EQ.3 was overlaid with the density 214 vs pressure 216 data obtained in-situ with the downhole acquisition tool 12. As shown in FIGS. 7-9, modeled density data 260 substantially fits the in-situ density data 220, 238, 242. Accordingly, with the unknown parameters in EQ. 3 determined, the compressibility model expressed in EQ. 8 is suitable to predict (e.g., estimate) the compressibility of the formation fluid 52 with a desirable degree of confidence.

Figure 10:
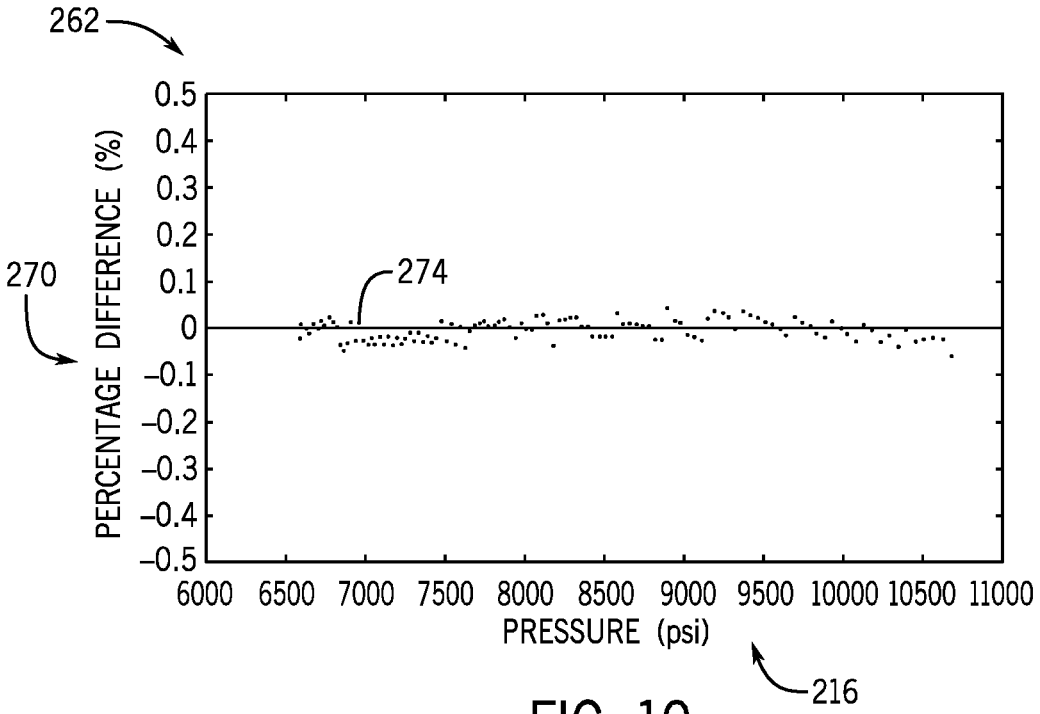
FIG. 10 is a representative plot of percentage difference between estimated and measured fluid density as a function of pressure for the gas condensate in FIG. 4 where fluid density data estimated using the compressibility model fits in-situ fluid density data measured using the downhole acquisition tool of FIG. 1 or 2, in accordance with an embodiment.
Figure 11:
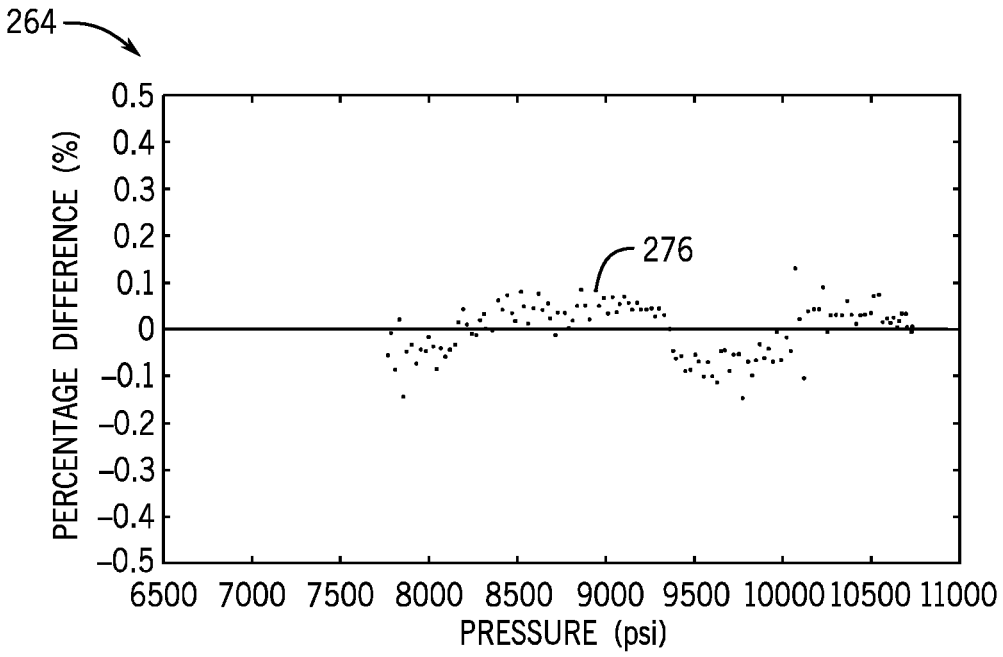
FIG. 11 is a representative plot of percentage difference between estimated and measured fluid density as a function of pressure for the black oil in FIG. 5 where fluid density data estimated using the compressibility model fits in-situ fluid density data measured using the downhole acquisition tool of FIG. 1 or 2, in accordance with an embodiment.
Figure 12:
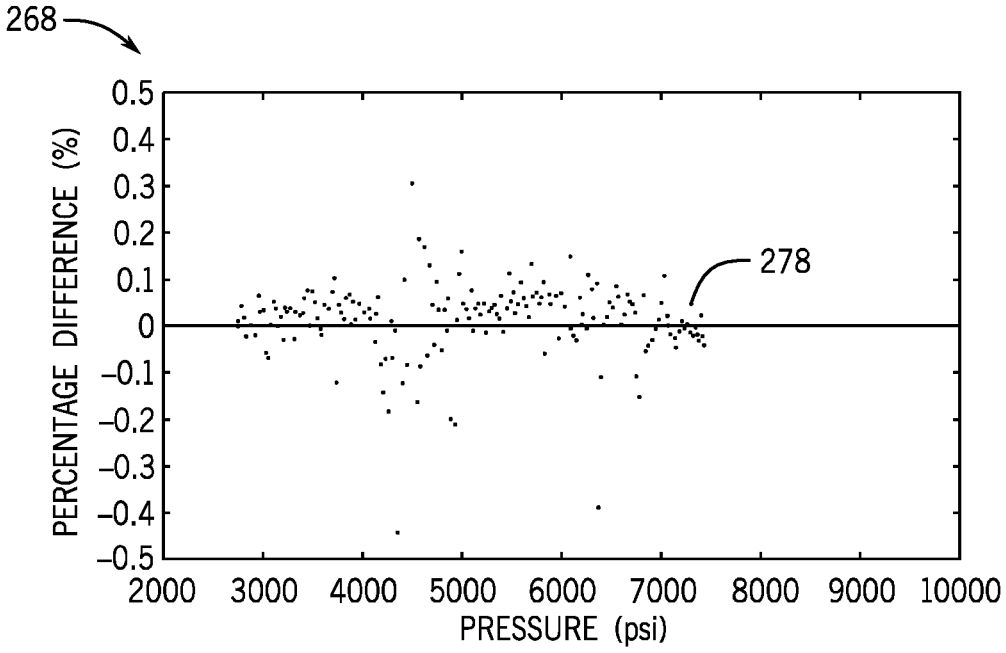
FIG. 12 is a representative plot of percentage difference between estimated and measured fluid density as a function of pressure for the black oil in FIG. 6 where fluid density data estimated using the compressibility model fits in-situ fluid density data measured using the downhole acquisition tool of FIG. 1 or 2, in accordance with an embodiment.

For example, FIGS. 10-12 show plots 262, 264, 268 of the percentage difference (%) 270 between the in-situ data 220, 238, 242, respectively, and the modeled density data 260 as a function of the pressure 216. The percentage difference 270 is defined as follows:

$$\frac{(\text{in-situ density data} - \text{modeled density data})(100\%)}{\text{modeled density data}} \quad \text{(EQ. 12)}$$

As shown in the plots 262, 264, 268, data points 274, 276, 278 show a percentage difference that is less than 0.1%. Accordingly, the compressibility model expressed in EQ. 8 is suitable for estimating the compressibility of the formation fluid 52 based at least in part on the fluid density or optical density of the formation fluid 52 as measured by the downhole acquisition tool 12. Certain data points 278 shown in FIG. 12 have a percentage difference above 0.1%. This may be due, in part, to noisy in-situ data 242 obtained by the downhole acquisition tool 12.

Figure 13:
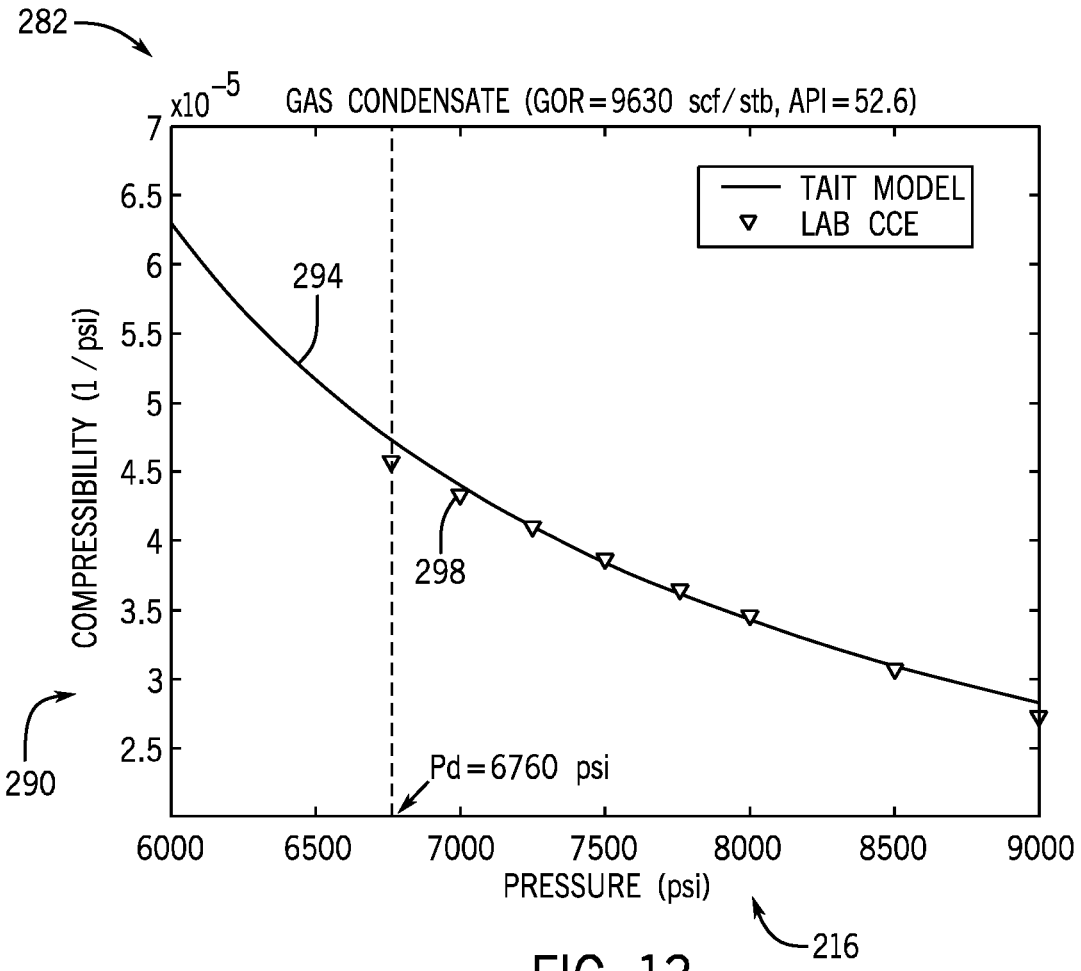
FIG. 13 is a representative plot of compressibility as a function of pressure for the gas condensate in FIG. 4 showing a comparison between compressibility derived from fluid density estimated using the density model and measured compressibility, in accordance with an embodiment.
Figure 14:
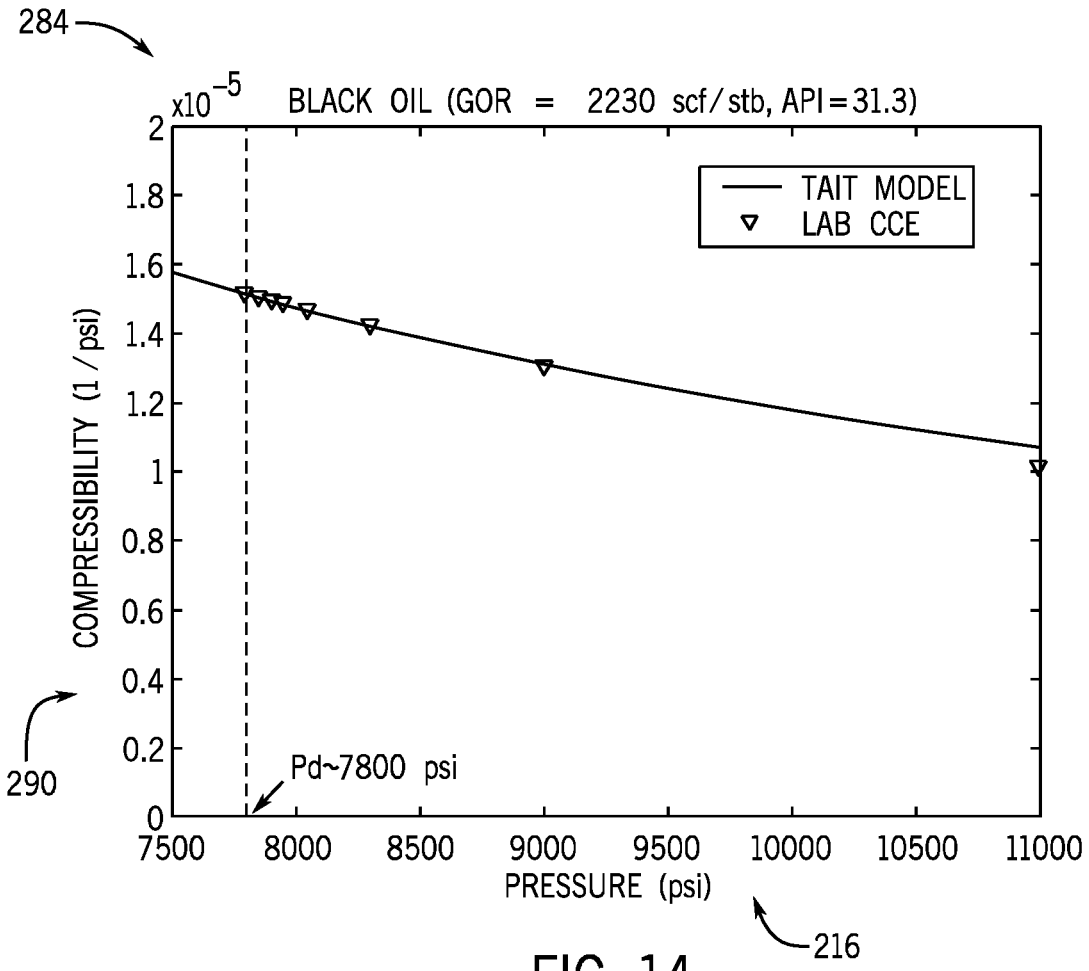
FIG. 14 is a representative plot of compressibility as a function of pressure for the black oil in FIG. 5 showing a comparison between compressibility derived from fluid density estimated using the density model and measured compressibility, in accordance with an embodiment.
Figure 15:
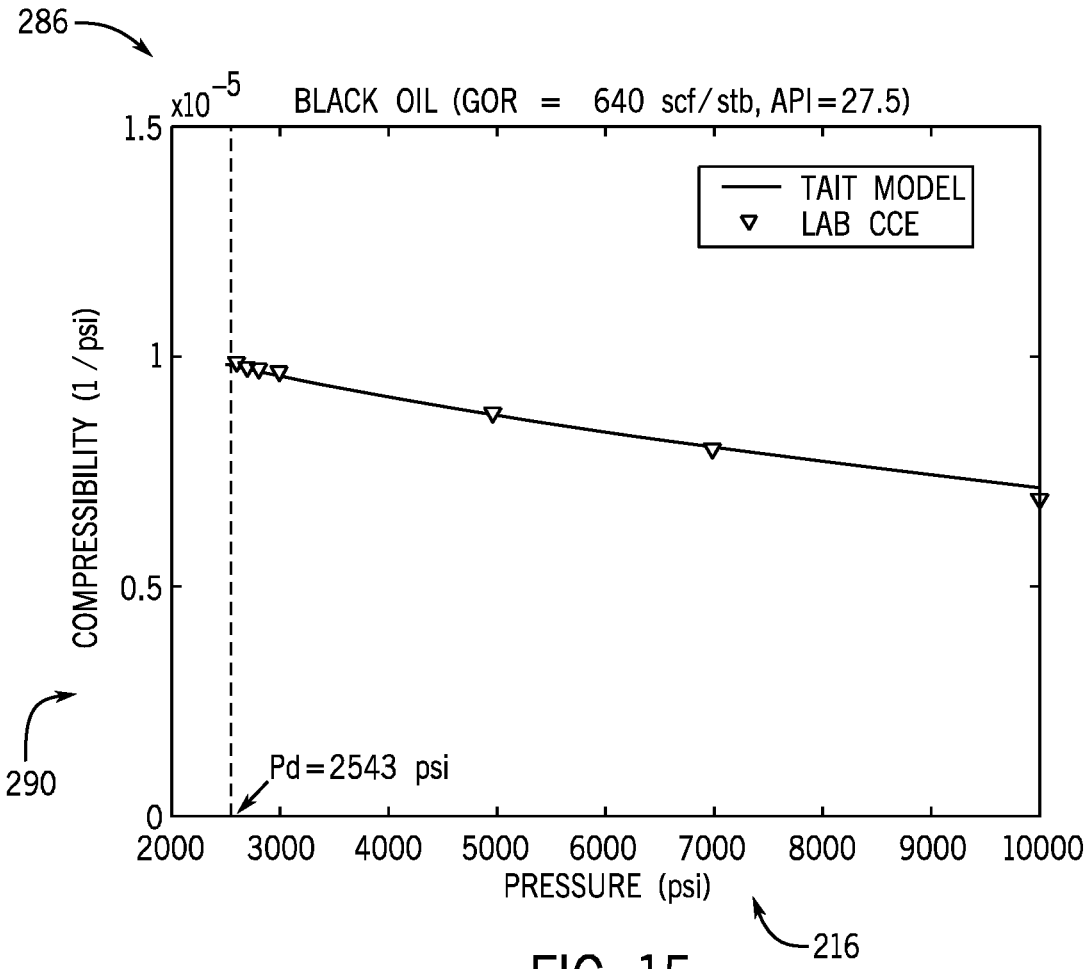
FIG. 15 is a representative plot of compressibility as a function of pressure for the black oil in FIG. 6 showing a comparison between compressibility derived from fluid density estimated using the density model and measured compressibility, in accordance with an embodiment.

FIGS. 13-15 show plots 282, 284, and 286 of compressibility 290 (1/psi) as a function of pressure 216 (psi) for the gas condensate, volatile black oil, and low GOR black oil example cases listed in Table 1. As shown in FIGS. 13-15, estimated modeled compressibility data 294 generated based at least in part on the compressibility model expressed in EQ. 8 matches laboratory compressibility data 298 measured in the laboratory. The similarity between the modeled compressibility data 294 and the laboratory compressibility data 298 indicates that the compressibility of the formation fluid 52 may be predicted with a suitable level of confidence using the compressibility model disclosed herein. Accordingly, the fluid compressibility of the formation fluid 52 may be determined using fluid properties such as fluid density and optical density of the formation fluid rather than using volume changes. As discussed above, certain existing compressibility models that rely on volume changes do not account for expansion of certain materials and seals within the sample flowline that may affect the overall volume of the sampled formation fluid 52 and result in inaccurate compressibility measurements. However, by using the compressibility model expressed in EQ. 8 above, the compressibility of the formation fluid 52 may be accurately determined compared to compressibility models that rely on volume The compressibility model expressed in EQ. 8 may be used to determine the compressibility of the formation fluid 52 in various scenarios that meet certain conditions (e.g., a closed system and pressurization). For example, in one embodiment, the compressibility model disclosed herein may be used to estimate the compressibility of the formation fluid 52 after a sample bottle of the downhole acquisition tool 12 is filled, the formation fluid 52 within the sample bottle is continuously pressurized to a desired pressure (e.g., a pressure that is between approximately XX psi and YY psi)

until a pump of the downhole acquisition tool 12 is stopped. The pressure within the flowline of the downhole acquisition tool 12 will also continuously ramp up due, in part, to the closed system created by sample bottle and the downhole acquisition tool 12. Accordingly, sensors within the downhole acquisition tool 12 may measure the fluid density of the sampled formation fluid 52 at the pressure range acquired during ramping. The measured fluid density may be used to fit with the density model expressed in EQ. 3 and estimate the fluid compressibility of the formation fluid 52 using the compressibility model expressed in EQ. 8.

Figure 16:
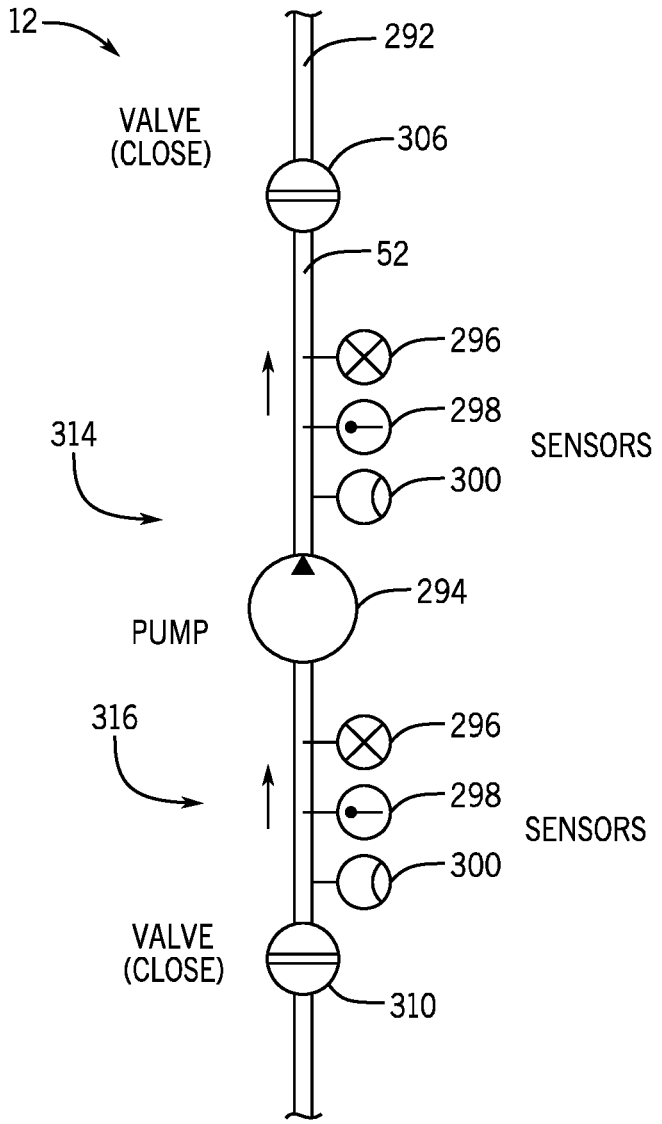
FIG. 16, is a schematic diagram of another embodiment of a wellsite system that may employ downhole fluid analysis methods for determining fluid properties and formation characteristics within a wellbore, in accordance with an embodiment.

In other embodiments, the sampled formation fluid 52 is trapped within the flowline of the data acquisition tool 12 as the tool 12 moves from one sampling station to another sampling station along the wellbore 14. As the downhole acquisition tool 12 transitions between sampling stations, the pump associated with the downhole acquisition tool 12 may be used to pressurize or depressurize the sampled formation fluid 52 trapped within the flowline of the downhole acquisition tool 12. For example, FIG. 16 illustrates an embodiment of the downhole acquisition tool 12 having a flowline 292 that includes multiple sensors along the flowline 292 and a pump 294 that motivates a flow of the sampled formation fluid 52 within the flowline 292. By way of non-limiting example, the sensors may include a pressure sensor 296, a temperature sensor 298, and a fluid density sensor 300. However, the downhole acquisition tool 12 may have additional sensors disposed along the flowline 292, such as an IFA spectrometer that measures the optical density of the sampled formation fluid 52 within the flowline 292. The flowline 292 includes an upper seal valve 306 and a lower seal valve 310 positioned along the flowline 292. The upper seal valve 306 may be closed to pressurize the sampled formation fluid 52 in a downstream portion 314 of the flowline 292 relative to the upper seal valve 306 using the pump 294. Simultaneously, the lower seal valve 310 may be closed to depressurize the sampled formation fluid 52 in an upstream portion 316 of the flowline 292 relative to the lower seal valve 310. The downhole acquisition tool 12 may measure the fluid density of the sampled formation fluid 52 during pressurization and depressurization within the flowline 292 during the transition between sampling stations. The acquired fluid density data obtained over the pressure ranges within the flowline 292 may be fitted with the density model expressed in EQ. 3 (or if optical density is measured, the optical density data is fitted with the density model expressed in EQ. 11) to determine unknown parameters in compressibility model expressed in EQ. 8. Once the unknown parameters are determined, the compressibility model is used to estimate the fluid compressibility of the formation fluid 52.

Figure 17:
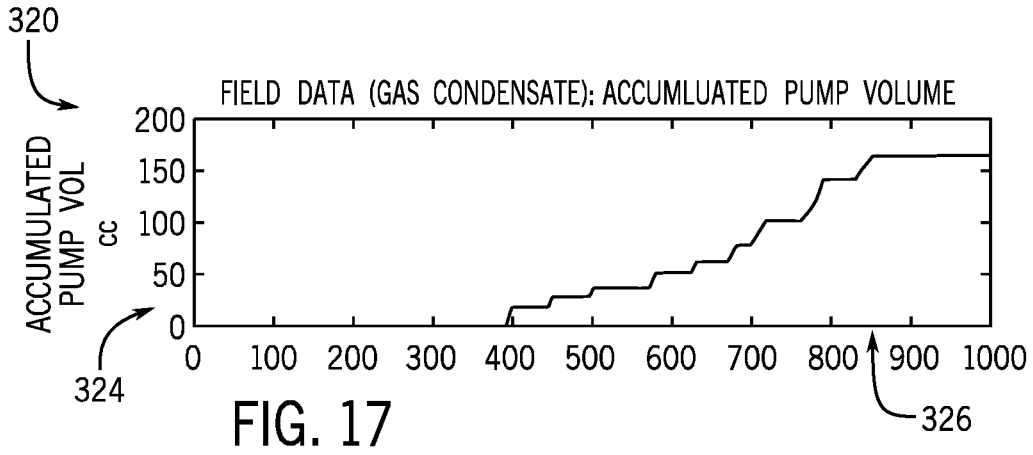
FIG. 17 is a representative plot of volume as a function of time for a reservoir fluid including gas condensate sampled using the downhole acquisition tool of FIG. 16, in accordance with an embodiment.
Figure 18:
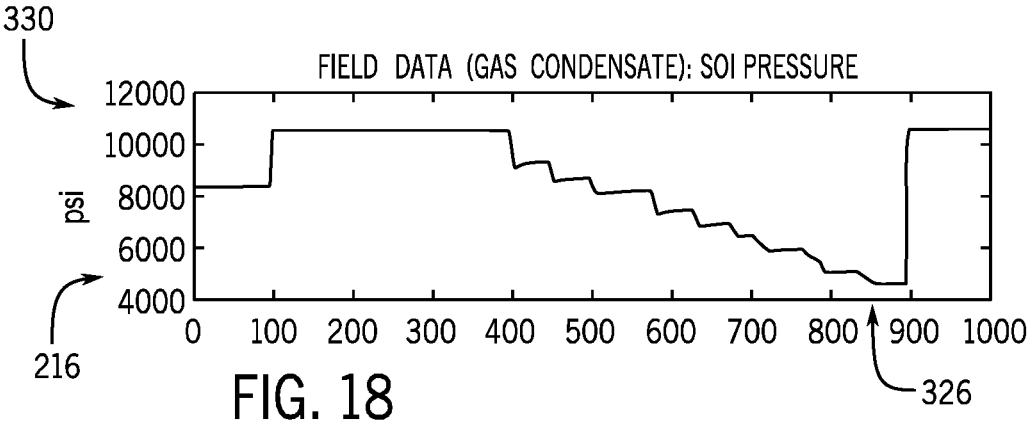
FIG. 18 is a representative plot of pressure as a function of time for the gas condensate of FIG. 17, in accordance with an embodiment.
Figure 19:
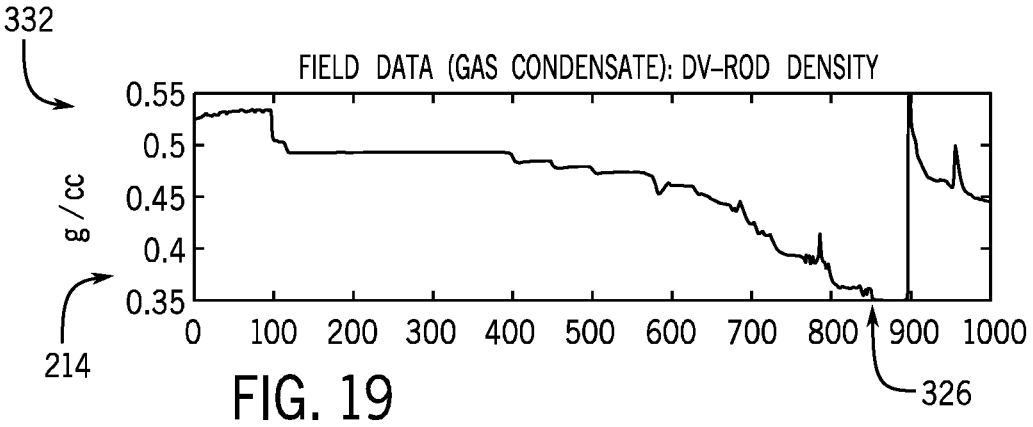
FIG. 19 is a representative plot of fluid density as a function of time for the gas condensate of FIG. 17, in accordance with an embodiment.
Figure 20:
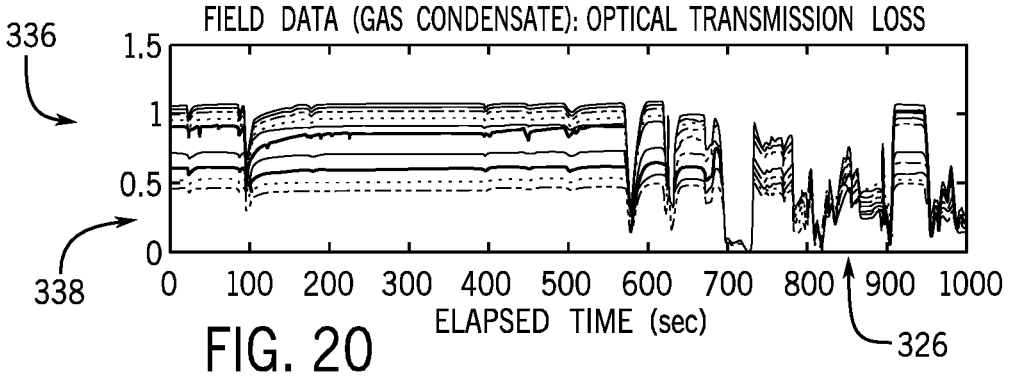
FIG. 20 is a representative plot of optical transmission loss as a function of time for the gas condensate of FIG. 17, in accordance with an embodiment.

FIGS. 17-20 show example plots of pump volume, pressure, fluid density, and transmission loss of a gas condensate field sample that was acquired using the downhole acquisition tool 12 at a time interval between a transition from one sampling station to another sampling station. For example, FIG. 17 shows a plot 320 of accumulated pump volume 324 (cc) during depressurizing the trapped fluid in the tool as a function of elapsed time 326 (seconds (sec)), FIG. 18 shows a plot 330 of the SOI pressure 216 (psi) as a function of the elapsed time 326, FIG. 19 shows a plot 332 of the fluid density 214 (g/cc) as a function of the elapsed time 326, and FIG. 20 shows a plot 336 of transmission loss 338 as a function of the elapsed time 326. The transmission loss 338 is derived from the optical density (OD) of the sampled fluid using the following relationship:

$$\text{transmission } los = 10^{-OD} \quad \text{(EQ. 13)}$$

The transmission loss may be used as an indication of liquid or dew dropout during pressure or temperature changes. The data in plots 320, 330, 332, and 336 was collected with the lower seal valve 310 closed, thereby trapping the gas condensate field sample in the upstream portion 316 of the flowline 292. As shown in the plot 320 of FIG. 17, the pump 294 begins to move and depressurized the trapped gas condensate field sample at approximately 400 seconds, and subsequent step-wise movement of the gas condensate field sample result in step-wise pressure drops, as shown in the plot 330 of FIG. 18. Accordingly, the fluid density 214 deceases in a manner similar to the pressure-drop, as illustrated in plot 332 of FIG. 19. Moreover, as shown in FIG. 20, dew dropout may be onset at about 580 seconds (or approximately 7500 psi (see, FIG. 18)).

Figure 21:
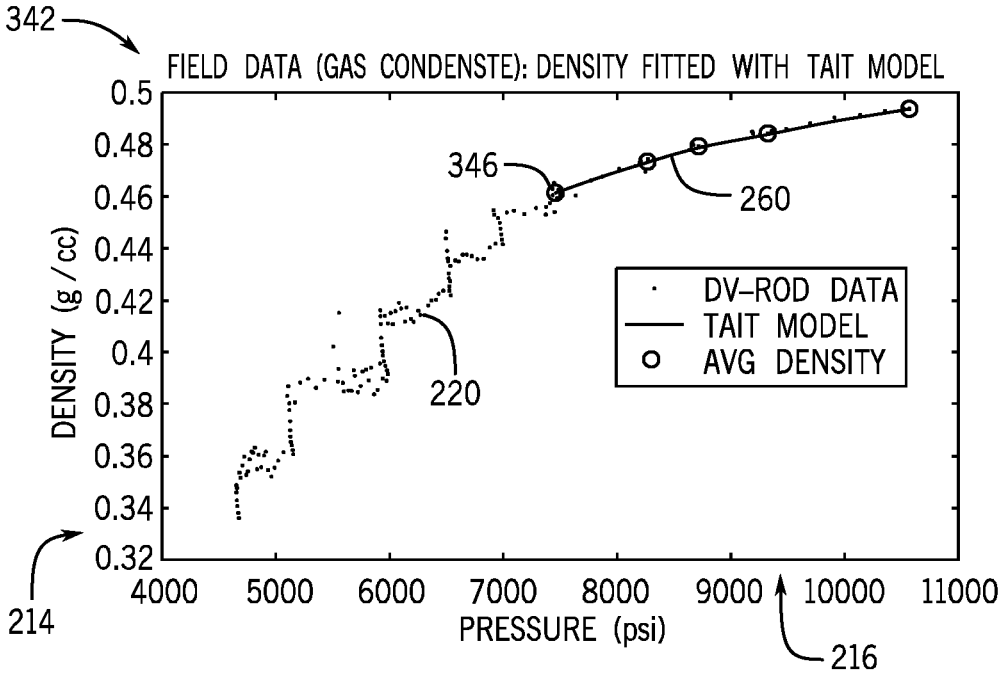
FIG. 21 is a representative plot of fluid density as a function of pressure for the gas condensate of FIG. 17 showing a comparison between in-situ fluid density data and fluid density data estimated using the density model, in accordance with an embodiment.

FIG. 21 shows a plot 342 of the fluid density 214 (g/cc) as a function of the pressure 216 (psi) of the gas condensate field sample during the time interval between approximately 350-800 seconds. The plot 342 includes average density 346 at each constant pressure level in the step-wise profile shown in FIG. 18. As shown in FIG. 21, modeled density data 260 obtained from the density model expressed in EQ. 3 fits the in-situ density data 220 acquired by the downhole acquisition tool 12 at pressures above 7500 psi. Accordingly, the modeled fluid density data determined using the density model disclosed herein may be used to model the compressibility of the gas condensate field sample over a desired pressure range.

Figure 22:
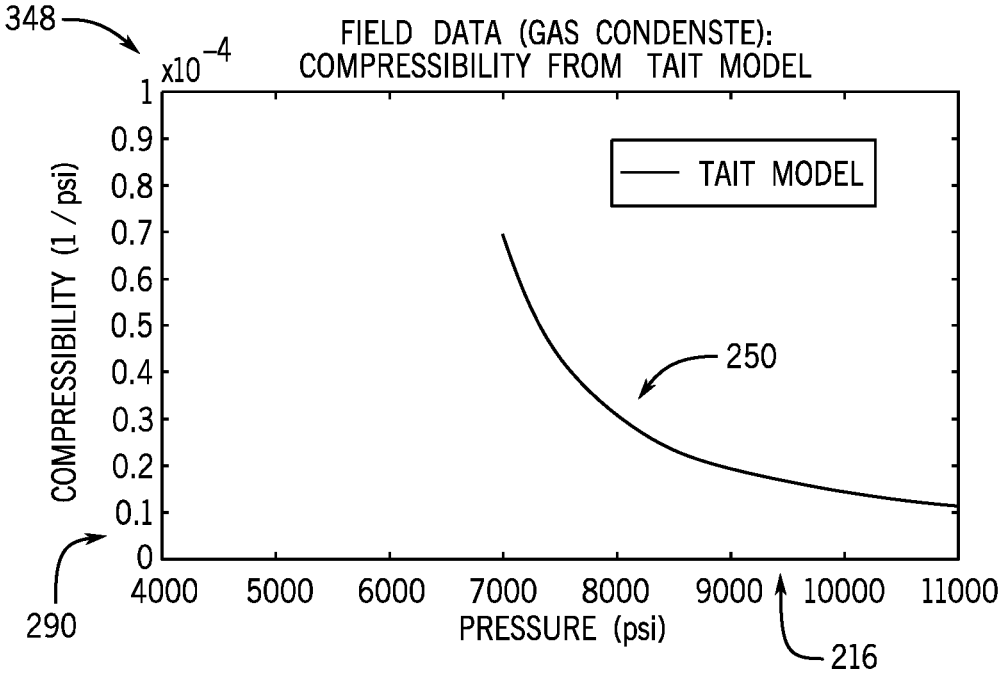
FIG. 22 is a representative plot of compressibility as a function of pressure of the gas condensate of FIG. 17 estimated using the compressibility model, in accordance with an embodiment.

FIG. 22 shows a plot 348 of the compressibility 290 (1/psi) as a function of the pressure 216 (psi) of the gas condensate field sample predicted using the compressibility model expressed in EQ. 8. As shown in the plot 348, the predicted compressibility 250 of the gas condensate field sample is between approximately $10^{-5}$ and $7\times10^{-5}$ 1/psi in the pressure range of approximately 7000-11000 psi, which is similar to the compressibility of the gas condensate field sample shown in FIG. 13.

Figure 23:
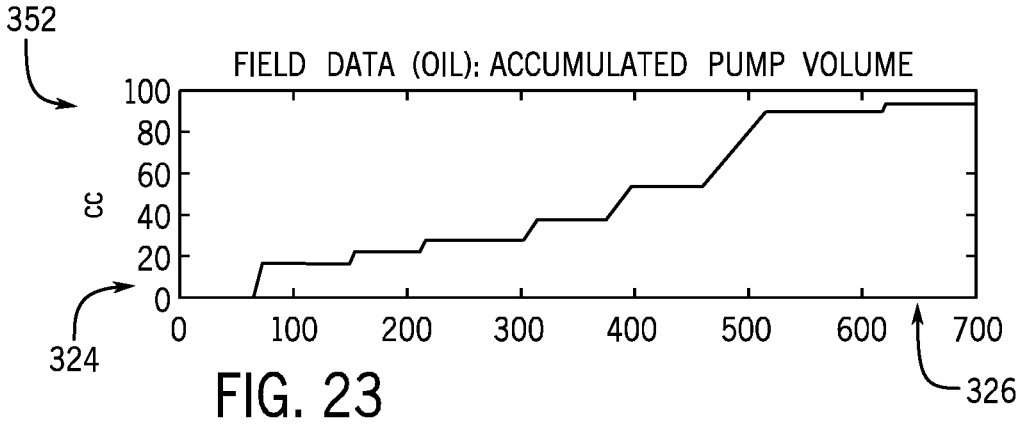
FIG. 23 is a representative plot of accumulated volume as a function of time for a reservoir fluid including black oil sampled using the downhole acquisition tool of FIG. 16, in accordance with an embodiment.
Figure 24:
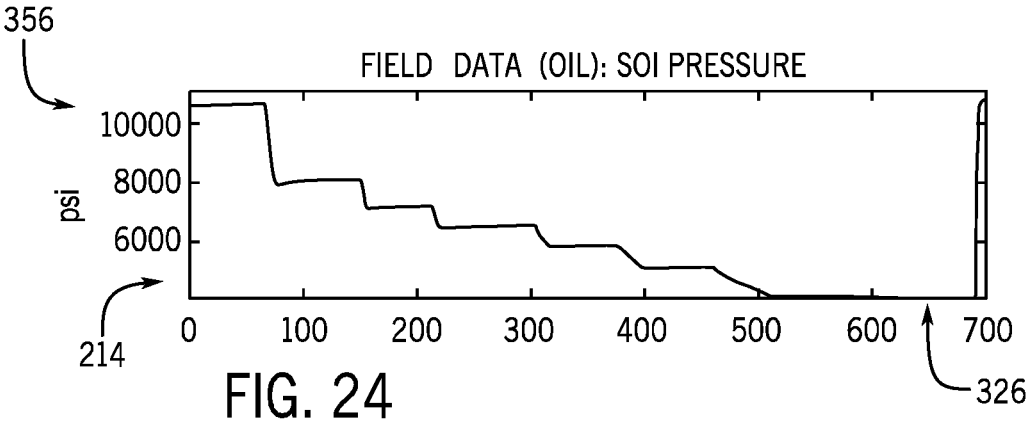
FIG. 24 is a representative plot of pressure as a function of time for the black oil of FIG. 23, in accordance with an embodiment.
Figure 25:
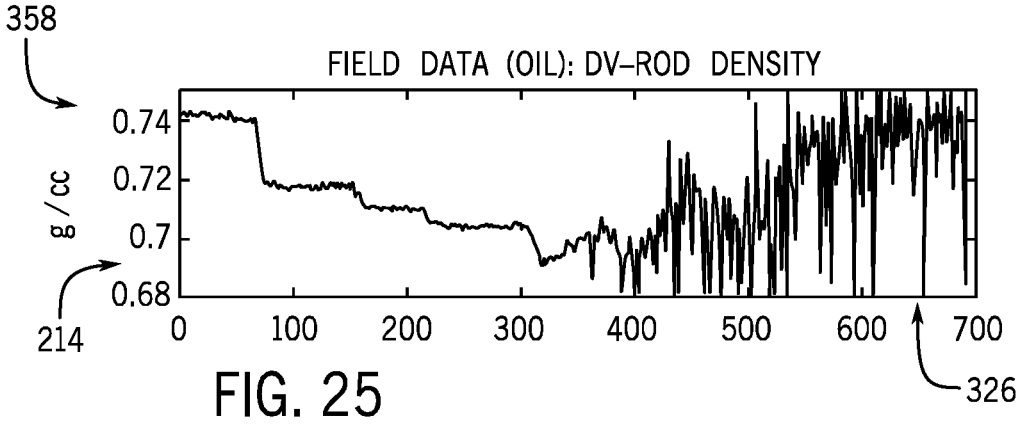
FIG. 25 is a representative plot of fluid density as a function of time for the black oil of FIG. 23, in accordance with an embodiment.
Figure 26:
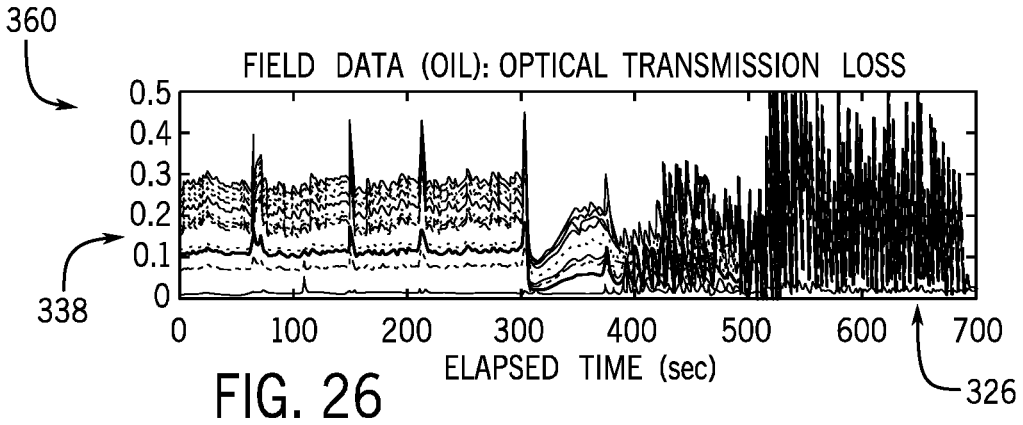
FIG. 26 is a representative plot of optical transmission loss as a function of time for the black oil of FIG. 23, in accordance with an embodiment.

The compressibility model disclosed herein was also used to evaluate black oil samples collected and trapped between two sampling stations within the wellbore 14 in a manner similar to the gas condensate discussed above with reference to FIGS. 17-22. Similar to FIGS. 17-20, FIGS. 23-26 show example plots of the pump volume, the pressure, the fluid density, and the transmission loss of a black oil field sample that was acquired using the downhole acquisition tool 12 at a time interval between a transition from one sampling station to another sampling station. For example, FIG. 23 shows a plot 352 of accumulated the pump volume 324 (cc) as a function of the elapsed time 326 (sec), FIG. 24 shows a plot 356 of the SOI pressure 216 (psi) as a function of the elapsed time 326 (sec), FIG. 25 shows a plot 358 of the fluid density 214 (g/cc) as a function of the elapsed time 326 (sec), and FIG. 26 shows a plot 360 of the transmission loss 338 as a function of the elapsed time 326 (sec). As shown in the plot 358 of FIG. 25, a step-wise decrease in the fluid density 214 occurs as the pump 294 depressurizes the trapped black oil within the flowline 292 (e.g., see the plot 356 of FIG. 24 for the pressure decrease of the black oil). Based at least in part on the transmission loss shown in plot 360 of FIG. 26, onset of saturation pressures occurs at approximately 300 seconds (or approximately 6000 psi, see FIG. 24).

Figure 27:
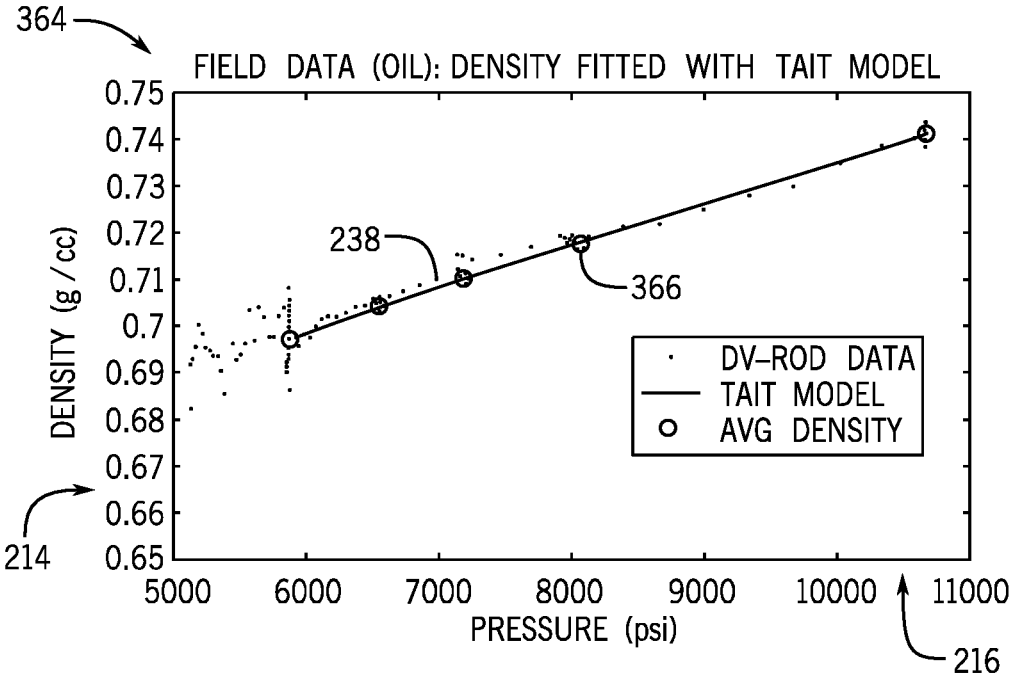
FIG. 27 is a representative plot of fluid density as a function of pressure for the black oil of FIG. 23 showing a comparison between in-situ fluid density data and fluid density data estimated using the compressibility model, in accordance with an embodiment.

FIG. 27 shows a plot 364 of the fluid density 214 (g/cc) as a function of the pressure 216 (psi) of the black oil field sample having the black oil in-situ density data 238, as measured by the downhole acquisition tool 12, the modeled density data 260, and black oil average density data 366. As shown in FIG. 27, the modeled density data 260 obtained from the compressibility model expressed in EQ. 8 fits the in-situ density data 238 at pressures above 6000 psi. Accordingly, the modeled fluid density data determined using the compressibility model disclosed herein may be used to model the compressibility of the gas condensate field sample over a desired pressure range.

Figure 28:
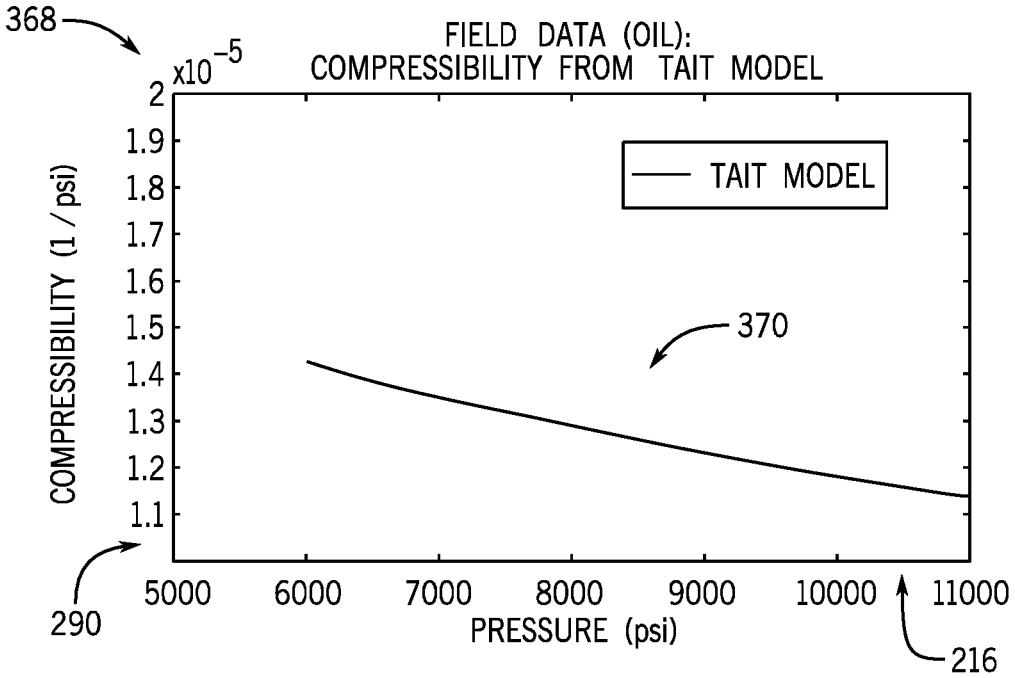
FIG. 28 is a representative plot of compressibility as a function of pressure of the black oil of FIG. 23 estimated using the compressibility model, in accordance with an embodiment.

FIG. 28 shows a plot 368 of the compressibility 290 (l/psi) as a function of the pressure 216 (psi) of the black oil field sample predicted using the compressibility model expressed in EQ. 8. As shown in the plot 368, predicted compressibility 370 of the black oil field sample is between approximately $1\times10^{-5}$ and $1.4\times10^{-5}$ l/psi in the pressure range of approximately 6000-11000 psi, which is similar to the compressibility of the black oil field sample shown in FIG. 14.

Figure 29:
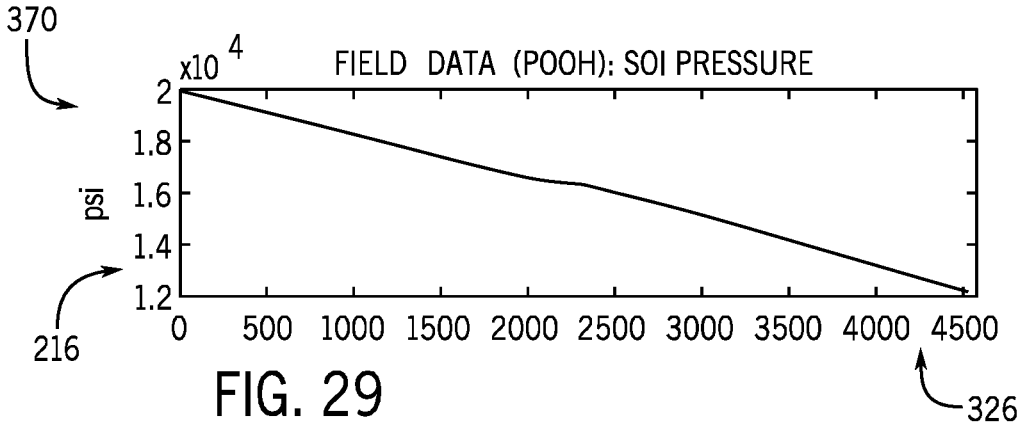
FIG. 29 is a representative plot of pressure as a function of time for a reservoir fluid trapped within the downhole acquisition tool of FIG. 16 when the downhole acquisition tool is pulled out of the hole, in accordance with an embodiment.
Figure 30:
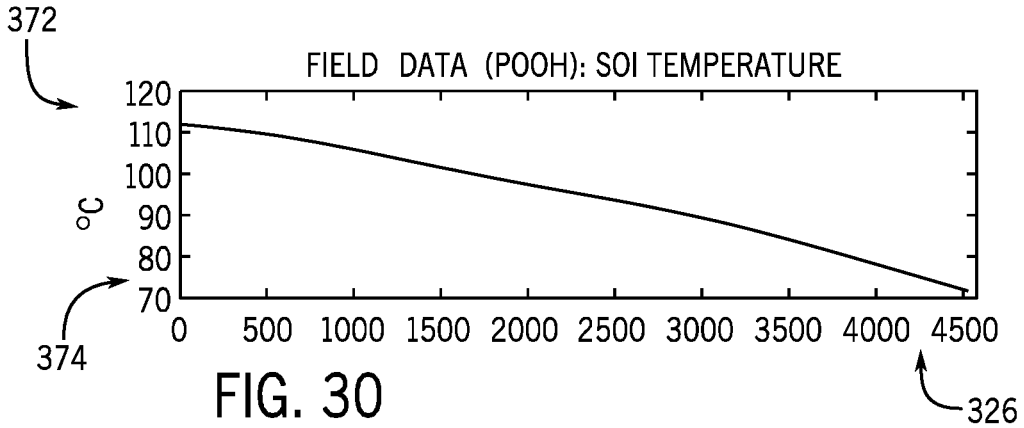
FIG. 30 is a representative plot of temperature as a function of time for reservoir fluid of FIG. 29, in accordance with an embodiment.
Figure 31:
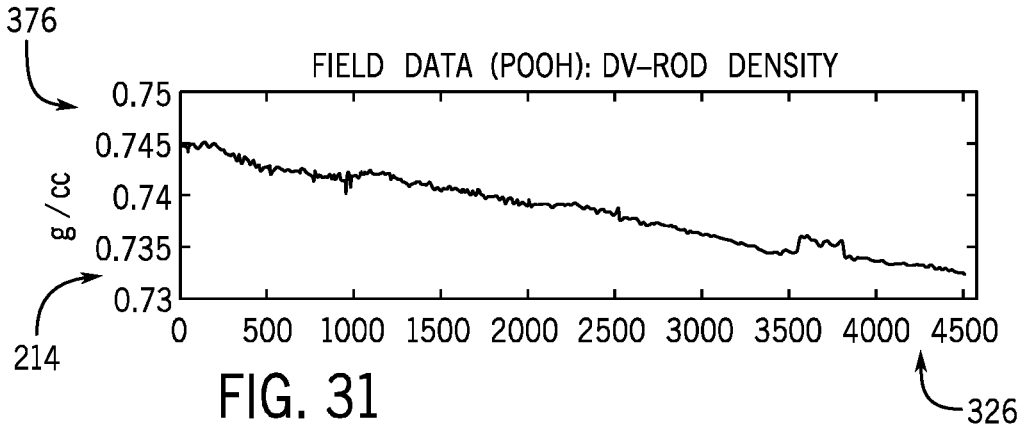
FIG. 31 is a representative plot of fluid density as a function of time for the reservoir fluid of FIG. 29, in accordance with an embodiment.
Figure 32:
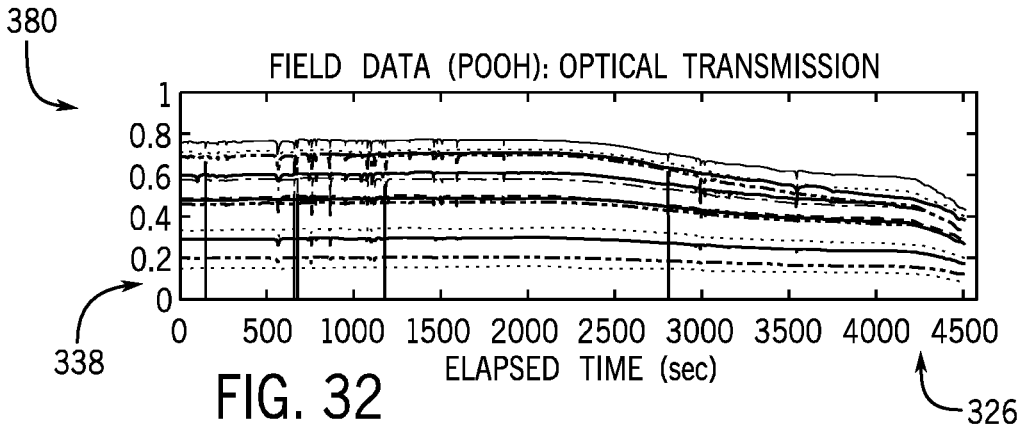
FIG. 32 is a representative plot of optical transmission loss as a function of time for the reservoir fluid of FIG. 29, in accordance with an embodiment.

In the examples discussed above, the pressure within the closed system of the downhole acquisition tool 12 varies and the temperature remains constant. However, in certain embodiments, both the temperature and the pressure vary when measuring the fluid density of the formation fluid 52. In particular, the temperature and the pressure of the formation fluid 52 sampled from the wellbore 14 may vary when the downhole acquisition tool 12 is pulled out of the wellbore 14. As such, the formation fluid 52 trapped within the flowline 292 of the downhole acquisition tool 12 may be exposed to various temperature and pressures during the removal of the downhole acquisition tool 12 from the wellbore 14. FIGS. 29-32 show example plots of the pressure, temperature, the fluid density, and the transmission loss of a field sample that was acquired when the downhole acquisition tool 12 was removed from the wellbore 14. For example, FIG. 29 shows a plot 370 of the SOI pressure 216 (psi) as a function of the elapsed time 326 (sec), FIG. 30 shows a plot 372 of SOI temperature 374 (degrees Celsius (° C.)) as a function of the elapsed time 326 (sec), FIG. 31 shows a plot 376 of the fluid density 214 (g/cc) as a function of the elapsed time 326 (sec), and FIG. 32 shows a plot 380 of the transmission loss 384 as a function of the elapsed time 326 (sec). As shown in the plots 370 and 372 of FIGS. 29 and 30, respectively, the pressure and temperature of the sampled formation fluid 52 gradually decreases over time in a non-step-wise manner as the downhole acquisition tool 12 depressurized the formation fluid 52 and is pulled out of the wellbore 14. During removal of the downhole acquisition tool 12 from the wellbore 14, the downhole acquisition tool 12 measures the fluid density of the formation fluid 52 trapped within the flowline 292. As shown in the plot 376 of FIG. 31, the fluid density 215 of the formation fluid also gradually decreases over time as the pressure and temperature of the sampled formation fluid 52 changes.

Figure 33:
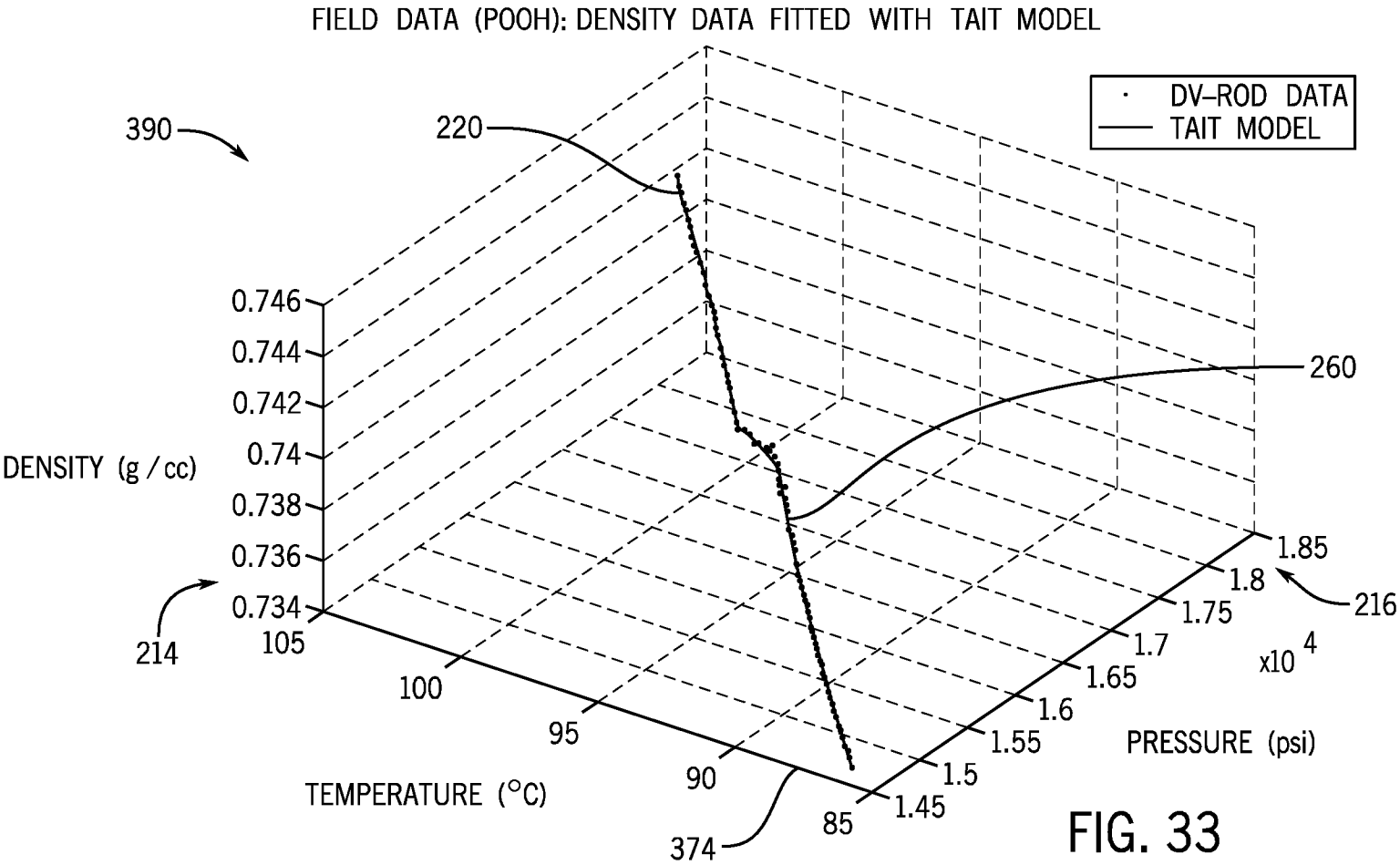
FIG. 33 is a representative cross-plot of the fluid density as a function of temperature and pressure for the reservoir fluid of FIG. 29 showing a comparison between in-situ fluid density data and fluid density data estimated using the density model, in accordance with an embodiment.

FIG. 33 shows a cross-plot 390 of the fluid density 214 (g/cc) as a function of the pressure 216 (psi) and temperature (° C.) 374 of the field sample discussed above with reference to FIGS. 29-32. In the plot 390 of FIG. 33, the in-situ density data 220 was plotted over the pressure 216 and the temperature 374 for a time interval of approximately 1000-3000 seconds. The density model of the present embodiments was used to predict the density 214 of the field sample and plotted as a function of the pressure 216 and the temperature 374. As shown, the modeled fluid density data 260 is substantially similar to the in-situ density data. That is, the density model expressed in EQ. 3 may be used to estimate the fluid density 214 of the formation fluid 52 at various temperatures and pressures. Accordingly, the modeled density data 260 obtained from the density model expressed in EQ. 3 fits the in-situ fluid density data 238 at pressures above 6000 psi. Therefore, the density model may be extrapolated to predict (estimate) the fluid density of the reservoir fluid 52 at any desired temperature and pressure. Accordingly, the modeled fluid density data 260 determined using the density model disclosed herein may be used to model the fluid density of the gas condensate field sample over a desired pressure range with a desired degree of accuracy.

Figure 34:
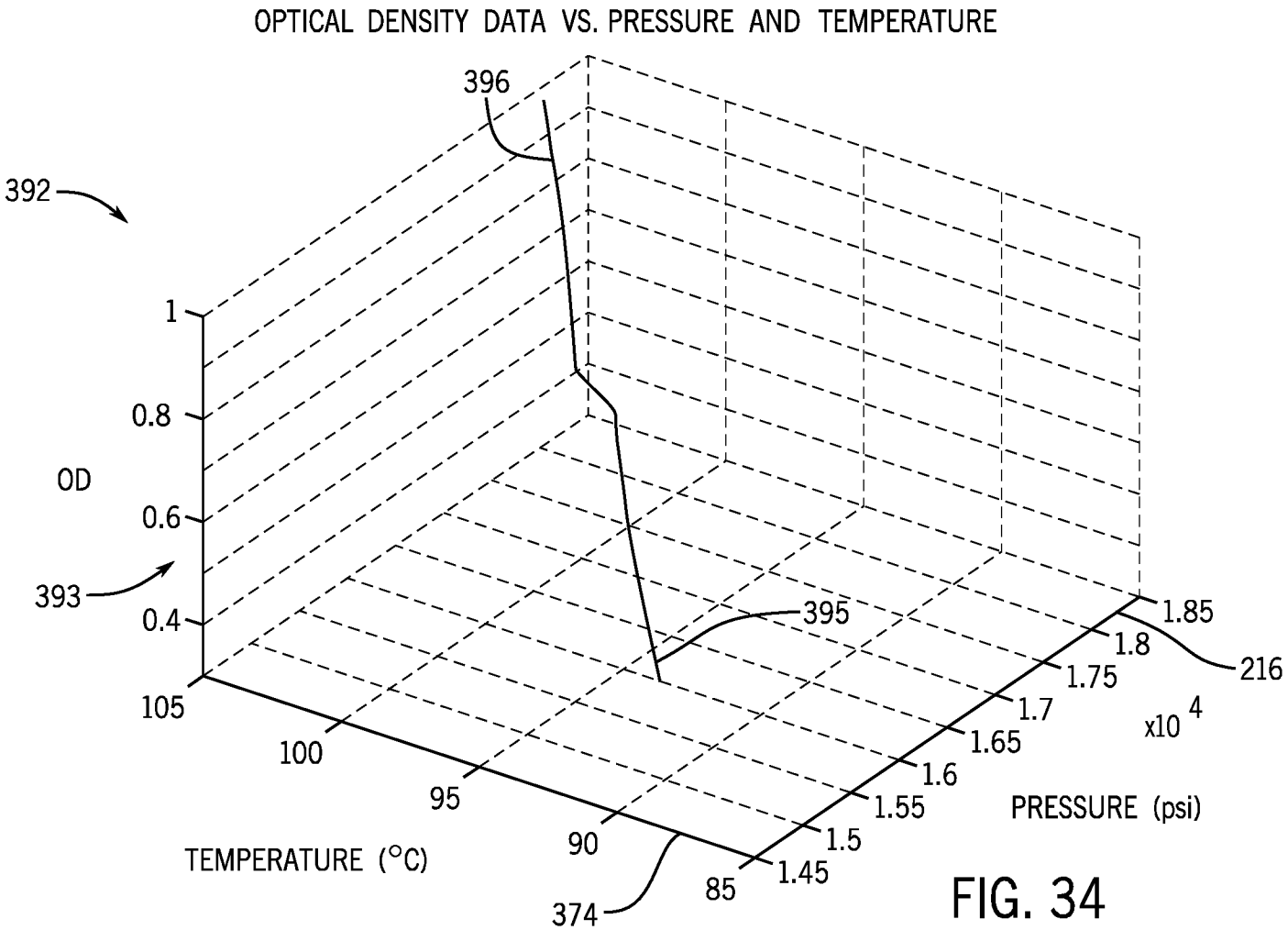
FIG. 34 is a representative cross-plot of the optical density as a function of temperature and pressure for the reservoir fluid of FIG. 29 showing a comparison between in-situ optical density data and optical density data estimated using the density model, in accordance with an embodiment.

Similarly, FIG. 34 shows a cross-plot 392 of the optical density 393 (OD) as a function of the pressure 216 (psi) and temperature (° C.) 374 of the field sample discussed above with reference to FIGS. 29-32. In the plot 392 of FIG. 34, the optical density data 393 was plotted over the pressure 216 and the temperature 374 for a time interval of approximately 1000-3000 seconds. The density model of the present embodiments was used to predict the optical density 393 of the field sample and plotted as a function of the pressure 216 and the temperature 374. As shown, modeled optical density data 395 is substantially similar to in-situ optical density data 396. Accordingly, the optical density model expressed in EQ. 11 may be used to estimate the optical density 393 of the formation fluid 52 at various temperatures and pressures. Therefore, the modeled optical density data 395 determined using the density model expressed in EQ. 11 may be used to model the optical density of the gas condensate field sample over a desired pressure range by extrapolating the optical density model.

Returning to the flowchart 200 of FIG. 3, once the compressibility of the formation fluid 52 is determined, according to the acts of block 208, the flowchart 200 includes determining a fluid type of the formation fluid 52 (block 394). As discussed above, the compressibility of a fluid may provide an indication as to the primary fluid type (e.g., gas, gas condensate, volatile oil, black oil, heavy oil, or water) in the fluid. Each fluid type and mixtures thereof may have a different compressibility. Therefore, by knowing the compressibility of the formation fluid 52, the data processing system 76 may determine a composition of the formation fluid 52. In particular, the data processing system 76 may identify the dominant (primary) fluid type of the formation fluid 52.

As discussed above, the compressibility model disclosed herein may be used to model the compressibility of formation fluids in a manner that is not dependent on the volume of the formation fluid sampled by the downhole acquisition too. By using the compressibility model disclosed herein, which uses fluid density and/or optical density, the accuracy of the compressibility of the formation fluid may be improved compared to compressibility models that rely on volume and do not include fluid density and/or optical density terms. This information may be used to determine a dominant fluid type (e.g., gas, oil, water) present in the reservoir. By knowing the dominant fluid type in the reservoir, operators may determine which enhance oil recovery (EOR) techniques may increase reservoir productivity.

The specific embodiments described above have been shown by way of example, and it should be understood that these embodiments may be susceptible to various modifications and alternative forms. It should be further understood that the claims are not intended to be limited to the particular forms discloses, but rather to cover modifications, equivalents, and alternatives falling within the spirit of this disclosure.

The invention claimed is:

1. A method comprising: operating a downhole acquisition tool in a wellbore in a geological formation, wherein the wellbore or the geological formation, or both, contain a reservoir fluid; receiving a portion of the reservoir fluid into the downhole acquisition tool; performing downhole fluid analysis using the downhole acquisition tool in the wellbore to determine at least one measurement associated with the portion of the reservoir fluid, wherein the at least one measurement comprises fluid density, optical density, or both; using a processor of the downhole acquisition tool to obtain compressibility of the reservoir fluid based at least in part on the fluid density, the optical density, or both, wherein the compressibility of the reservoir fluid is obtained without using a volume of the portion of the reservoir fluid, and wherein the processor obtains the compressibility c of the reservoir fluid using the following relationship:

$$c = \frac{1}{\rho}\left(\frac{d\rho}{dp}\right)_T = \frac{c}{B(T)+P}\left(1 - C\log\frac{B(T)+P}{B(T)+P_0}\right)^{-1}$$

where ρ represents the fluid density of the reservoir fluid;

P represents pressure of the reservoir fluid;

T represents temperature of the reservoir fluid;

$B=A_0+A_ST+A_2T^2$; where $A_0$, $A_1$ and $A_2$ are parameters estimated from fitting isothermal fluid density vs pressure and temperature data acquired by the downhole acquisition tool;

C is a parameter estimated from fitting isothermal pressure vs fluid density data acquired by the downhole acquisition tool;

subscript 0 denotes saturation pressure of the reservoir fluid; and determining a fluid type of the reservoir fluid based at least in part on the compressibility.

2. The method of claim 1, comprising depressurizing the portion of the reservoir fluid within the downhole acquisition tool, wherein the at least one measurement is determined during depressurization of the reservoir fluid.

3. The method of claim 1, comprising pressurizing the portion of the reservoir fluid within the downhole acquisition tool, wherein the at least one measurement is determined during pressurization of the reservoir fluid.

4. The method of claim 1, wherein the processor is configured to model a fluid density of the reservoir fluid according to a density model that accords to the following relationship:

$$\frac{\rho-\rho_0}{\rho} = C\log\frac{B+P}{B+P_0}$$

where ρ represents the fluid density of the reservoir fluid;

P represents pressure of the reservoir fluid;

$P_0$ represents a saturation pressure of the reservoir fluid;

$\rho_0$ represents fluid density at the saturation pressure.

5. The method of claim 4, wherein the parameters C and B are estimated by fitting the fluid density measured by the downhole acquisition tool to the density model.

6. The method of claim 4, comprising estimating the fluid density of the reservoir fluid using the fluid density model over a range of temperature and pressure.

7. The method of claim 4, wherein fitting the fluid density vs pressure and temperature accords to the following relationship:

$$X^2 = \frac{\sum_{i=1}^{N}\left|\rho_i - \rho_0\left(1 - C\log\left(\frac{B(T_i)+P_i}{B(T_i)+P_0}\right)\right)^{-1}\right|^2}{v}$$

where subscript i denotes measured data;

$\rho_0$ represents fluid density at the saturation pressure;

$X^2$ represents a minimized sum of squares of a deviation of the at least one measurement associated with the portion of the reservoir fluid from the density model; and v is number of degrees of freedom for fitting N data points.

8. The method of claim 1, is configured to model optical density of the reservoir fluid according to an optical density model that accords to the following relationship:

$$\frac{OD-OD_0}{OD} = C\log\left(\frac{B+P}{B+P_0}\right)$$

where

OD is the optical density at a wavelength;

$P_0$ represents a saturation pressure of the reservoir fluid; and $OD_0$ represents the optical density measured at the saturation pressure $P_0$ of the reservoir fluid at the wavelength.

9. One or more tangible, non-transitory, machine-readable media comprising instructions to:

receive a fluid parameter of a portion of fluid as analyzed by a downhole acquisition tool in a wellbore in a geological formation, wherein the wellbore or the geological formation, or both, contains the fluid, wherein the fluid comprises a gas, oil, water, or a combination thereof, and wherein the fluid parameter includes a measured fluid density, an optical density, or both of the portion of the fluid;

estimate a compressibility of the portion of the fluid based at least in part on a fluid density, the optical density, or both of the portion of the fluid, wherein the compressibility of the portion of the fluid is obtained without using a volume of the portion of the fluid, and wherein the compressibility is determined using a compressibility model, wherein the compressibility model accords with the following relationship:

$$c = \frac{1}{\rho}\left(\frac{d\rho}{dp}\right)_T = \frac{C}{B(T)+P}\left(1 - C\log\frac{B(T)+P}{B(T)+P_0}\right)^{-1}$$

where

ρ represents the fluid density of the fluid;

P represents the pressure of the reservoir fluid;

T represents temperature of the reservoir fluid;

$B=A_0+A_1T+A_2T^2$: where $A_0$, $A_1$ and $A_2$ are parameters estimated from fitting isothermal fluid density vs pressure and temperature data acquired by the downhole acquisition tool;

C is a parameter estimated from fitting isothermal pressure vs fluid density data acquired by the downhole acquisition tool; and subscript 0 denotes saturation pressure of the reservoir fluid; and determine a composition of the fluid based at least in part on the compressibility.

10. The one or more tangible, non-transitory, machine-readable media of claim 9, comprising instructions to execute the compressibility model at varying pressures and temperatures of the geological formation to predict the compressibility of the fluid.

11. The one or more tangible, non-transitory, machine-readable media of claim 9, comprising instructions to model a fluid density of the reservoir fluid according to the following relationship:

$$\frac{\rho-\rho_0}{\rho}=C\log\frac{B+P}{B+P_0}$$

where ρ represents the fluid density of the reservoir fluid;

P represents pressure of the reservoir fluid;

$P_0$ represents a saturation pressure of the reservoir fluid;

$\rho_0$ represents fluid density at the saturation pressure.

12. The one or more tangible, non-transitory, machine-readable media of claim 11, wherein the parameters C and B are estimated by fitting the fluid density measured by the downhole acquisition tool to the density model.

13. The one or more tangible, non-transitory, machine-readable media of claim 11, comprising estimating the fluid density of the reservoir fluid using the fluid density model over a range of temperature and pressure.

14. The one or more tangible, non-transitory, machine-readable media of claim 9, comprising instructions to estimate the parameter C and B according to the following relationship:

$$\frac{\rho-\rho_0}{\rho}=C\log\frac{B+P}{B+P_0}$$

where $P_0$ represents a saturation pressure of the reservoir fluid; and $\rho_0$ represents fluid density at the saturation pressure.

15. The one or more tangible, non-transitory, machine-readable media of claim 9, comprising instructions to estimate the parameter C and B according to the following relationship:

$$\frac{OD-OD_0}{OD}=C\log\left(\frac{B+P}{B+P_0}\right)$$

where

OD is the optical density at a wavelength;

$P_0$ represents a saturation pressure of the reservoir fluid; and $OD_0$ represents the optical density measured at the saturation pressure $P_0$ of the reservoir fluid at the wavelength.

16. The one or more tangible, non-transitory, machine-readable media of claim 9, comprising instructions to fit fluid density vs pressure and temperature according to the following relationship:

$$X^2=\frac{\sum_{i=1}^{N}\left|\rho_i-\rho_0\left(1-C\log\left(\frac{B(T_i)+P_i}{B(T_i)+P_0}\right)\right)^{-1}\right|^2}{v}$$

where subscript i denotes measured data;

$X^2$ represents a minimized sum of squares of a deviation of the at least one measurement associated with the portion of the reservoir fluid from the density model; and v is number of degrees of freedom for fitting N data points.

* * * * *